US009037011B2

(12) United States Patent
Tsuruya

(10) Patent No.: US 9,037,011 B2
(45) Date of Patent: May 19, 2015

(54) COLOR-IMAGE FORMING APPARATUS

(75) Inventor: Takaaki Tsuruya, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 41 days.

(21) Appl. No.: 13/994,027

(22) PCT Filed: Dec. 9, 2011

(86) PCT No.: PCT/JP2011/079121
§ 371 (c)(1),
(2), (4) Date: Jun. 13, 2013

(87) PCT Pub. No.: WO2012/081686
PCT Pub. Date: Jun. 21, 2012

(65) Prior Publication Data

US 2013/0272731 A1 Oct. 17, 2013

(30) Foreign Application Priority Data

Dec. 15, 2010 (JP) ..... 2010-279897
Nov. 30, 2011 (JP) ..... 2011-262126

(51) Int. Cl.
*G03G 15/01* (2006.01)
*G03G 15/043* (2006.01)
*G03G 15/00* (2006.01)

(52) U.S. Cl.
CPC ..... *G03G 15/01* (2013.01); *G03G 15/0189* (2013.01); *G03G 15/043* (2013.01); *G03G 15/5058* (2013.01); *G03G 15/0131* (2013.01); *G03G 2215/0132* (2013.01); *G03G 2215/0161* (2013.01)
USPC ..... 399/39; 399/49; 399/116; 399/301

(58) Field of Classification Search
USPC ..... 399/39, 49, 116, 301
See application file for complete search history.

(56) References Cited

U.S. PATENT DOCUMENTS

| | | | |
|---|---|---|---|
| 2005/0200689 A1 | 9/2005 | Shinohara et al. | |
| 2006/0275057 A1 | 12/2006 | Suzuki | |
| 2009/0003893 A1 | 1/2009 | Nishikawa et al. | |
| 2012/0003016 A1* | 1/2012 | Uchiyama et al. | 399/301 |

FOREIGN PATENT DOCUMENTS

| | | | |
|---|---|---|---|
| CN | 101231486 | A | 7/2008 |
| CN | 101261467 | A | 9/2008 |
| JP | H07-234612 | A | 9/1995 |
| JP | H10-039571 | A | 2/1998 |
| JP | H10-123791 | A | 5/1998 |
| JP | 2003-029544 | A | 1/2003 |
| JP | 2004-279823 | A | 10/2004 |
| JP | 2005-164722 | A | 6/2005 |

(Continued)

*Primary Examiner* — David Gray
*Assistant Examiner* — Michael Harrison
(74) *Attorney, Agent, or Firm* — Canon USA Inc IP Division

(57) ABSTRACT

In an image forming apparatus that forms an electrostatic latent image for detection on a photosensitive member by light irradiation and performs color-misregistration correction control on the basis of detection of a change in detection current due to the detecting electrostatic latent image passing through a processing unit disposed close to the periphery of the photosensitive member, the intensity of at least one of the apply voltage of the processing unit and the output of the light irradiation unit is set higher than that during normal image formation.

9 Claims, 18 Drawing Sheets

(56) References Cited

FOREIGN PATENT DOCUMENTS

| | | | |
|---|---|---|---|
| JP | 2005-221622 | A | 8/2005 |
| JP | 2005-292735 | A | 10/2005 |
| JP | 2007-156455 | A | 6/2007 |
| JP | 2010-085462 | A | 4/2010 |

* cited by examiner

SETTING DURING NORMAL IMAGE OUTPUT

SETTING IN WHICH ABSOLUTE VALUE OF VD IS SET LARGE AND ABSOLUTE VALUE OF VL IS SET SMALL

SHEET SIZE A4, NO-IMAGE AREA WIDTH 64.0 mm, DRUM PERIMETER 75.4 mm

SHEET SIZE A4, NO-IMAGE AREA WIDTH 52.0 mm, DRUM PERIMETER 69.12 mm

COLOR-IMAGE FORMING APPARATUS

TECHNICAL FIELD

The present invention relates to a color-image forming apparatus of an electrophotographic system and, in particular, to an image forming apparatus capable of forming an electrostatic latent image.

BACKGROUND ART

A known electrophotographic color-image forming apparatus adopts a so-called in-line system having independent image forming units of different colors to achieve high-speed printing. This in-line color-image forming apparatus is configured to transfer images from the color image forming units to an intermediate transfer belt in sequence and to further transfer the images together from the intermediate transfer belt to a recording medium.

In such a color-image forming apparatus, color misregistration (positional misalignment) occurs due to a mechanical factor of the color image forming units when images are overlapped. In particular, with a configuration in which a laser scanner (optical scanning unit) and a photosensitive drum are provided for each of the color image forming units, the positional relationship between the laser scanner and the photosensitive drum differs from color to color, which hinders synchronizing laser scanning positions on the photosensitive drums, thus causing color misregistration. To correct such color misregistration, the above color-image forming apparatus performs color-misregistration correction control. PTL 1 discloses an image forming apparatus that performs color-misregistration correction control by transferring color toner images for detection from photosensitive drums onto an image bearing member (an intermediate transfer belt or the like) and by detecting the relative position of the detecting toner images in a scanning direction and a conveying direction using an optical sensor.

However, the detection of detecting toner images with the optical sensor in the known color-misregistration correction control in the related art has the following problem. That is, since detecting toner images (a density of 100%) are transferred from the photosensitive drums to the image bearing member (belt) for color-misregistration correction control, it takes much time and effort to remove them, thus reducing the usability of the image forming apparatus.

CITATION LIST

Patent Literature

PTL 1 Japanese Patent Laid-Open No. 7-234612
PTL 2 Japanese Patent Laid-Open No. 2007-156455

SUMMARY OF INVENTION

The present invention solves at least one of the above problem and other problems. For example, the present invention solves the problem of detection of the detecting toner images with an optical sensor in the related art to enhance the usability of the image forming apparatus. The other problems are to be understood through the entire specification.

The present invention includes the following configuration: (1) A color-image forming apparatus including image forming units for individual colors and a belt, the image forming units each including a photosensitive member that is rotationally driven, a processing unit that is disposed close to the periphery of the photosensitive member and that is configured to act on the photosensitive member, and a light irradiation unit configured to emit light to form an electrostatic latent image on the photosensitive member, wherein toner images are formed on the belt by operating the image forming units, the apparatus comprising a forming unit configured to form electrostatic latent images for color misregistration correction on the photosensitive members of the individual colors by controlling the light irradiation units corresponding to the individual colors; a power supply unit for each of the processing units corresponding to the individual colors; a detecting unit configured to detect, for each of the colors, the output of the power supply unit when the electrostatic latent image for color misregistration correction formed on each of the photosensitive members of the individual colors passes through a position facing the processing unit; and a controller configured to perform color-misregistration correction control so as to return a color misregistration state to a reference state on the basis of a detection result of the detecting unit, wherein when the color-misregistration correction control is to be performed, the intensity of at least one of the apply voltage of the processing unit and the output of the light irradiation unit is set higher than that during normal image formation.

Further features of the present invention will become apparent from the following description of exemplary embodiments with reference to the attached drawings.

DESCRIPTION OF EMBODIMENTS

Embodiments of the present invention will be described in detail hereinbelow with reference to the drawings. However, components described in the embodiments are given as an example only and are not intended to limit the scope of the present invention. First, a first embodiment will be described.

Schematic Diagram of In-line (Four-drum) Color-image Forming Apparatus

Figure 1:
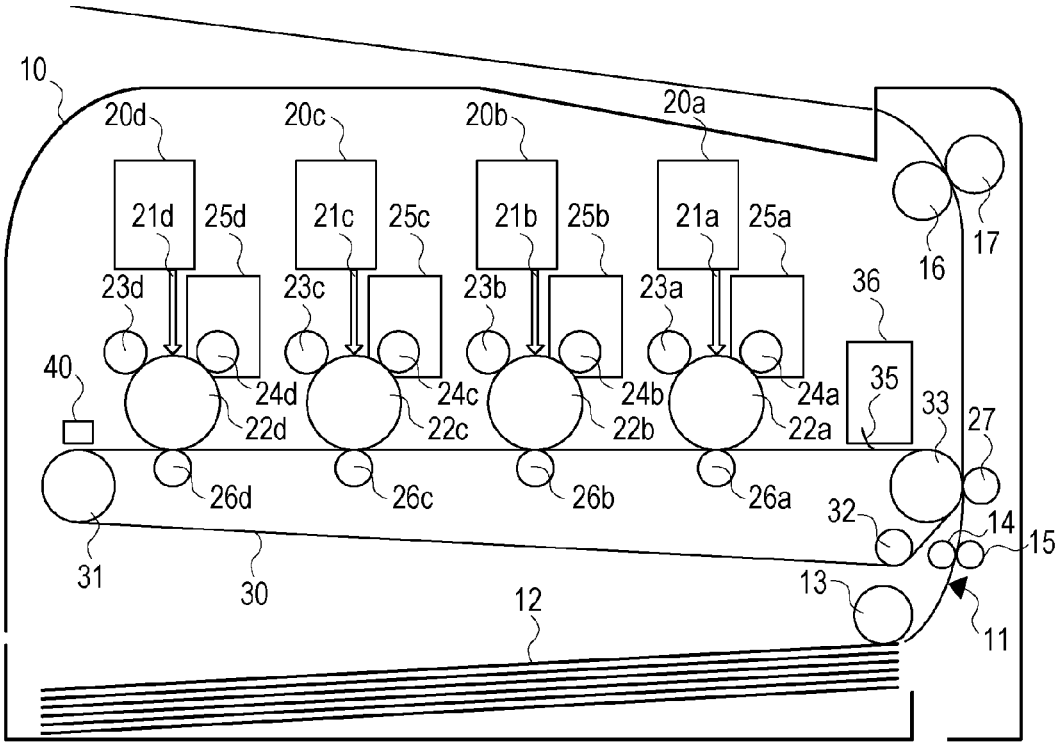
FIG. 1 is a diagram showing the configuration of an in-line (four-drum) color-image forming apparatus.

FIG. 1 is a diagram showing the configuration of an in-line (four-drum) color-image forming apparatus 10. A recording medium 12 run out by a pickup roller 13 is, after the leading end thereof is detected by a registration sensor 11, temporarily stopped at a position where the leading end has a little passed through a conveying roller pair 14 and 15.

On the other hand, scanner units 20*a* to 20*d* irradiate rotationally driven photosensitive drums 22*a* to 22*d* (photosensitive members 22*a* to 22*d*) with laser beams 21*a* to 21*d* in sequence. At that time, the photosensitive drums 22*a* to 22*d* are charged in advance by charging rollers 23*a* to 23*d*. From the individual charging rollers 23*a* to 23*d*, for example, a voltage of −1.0 kV is output, and the surfaces of the photosensitive drums 22*a* to 22*d* are charged at, for example, −700 V. At this charging potential, electrostatic latent images are formed by irradiation of the laser beams 21*a* to 21*d*, the potential of portions where electrostatic latent images are formed becomes, for example, −100 V. Developing units 25*a* to 25*d* and developing sleeves 24*a* to 24*d* output a voltage of, for example, −350 V, to place toner on electrostatic latent images on the photosensitive drums 22*a* to 22*d*, thereby forming toner images on the photosensitive drums 22*a* to 22*d*. Primary transfer rollers 26*a* to 26*d* output a positive voltage of, for example, +1.0 kV to transfer the toner images on the photosensitive drums 22*a* to 22*d* to an intermediate transfer belt 30 (endless belt). A component group that is directly concerned with toner image formation, such as the scanner unit 20, the photosensitive drums 22*a* to 22*d*, the charging rollers 23*a* to 23*d*, the developing units 25*a* to 25*d*, and the primary transfer rollers 26*a* to 26*d*, are referred to as an image forming unit. It may also be referred to as the image forming unit without the scanner unit 20 in some cases. The components (charging rollers 23*a* to 23*d*, developing units 25*a* to 25*d*, and primary transfer rollers 26*a* to 26*d*) disposed close to the periphery of the photosensitive drums 22*a* to 22*d* and acting on the photosensitive drums 22*a* to 22*d* are referred to as processing units. A plurality of kinds of components can take charge of processing units as described above.

The intermediate transfer belt 30 is rotationally driven by rollers 31, 32, and 33 to convey toner images to a position on a secondary transfer roller 27. At that time, the conveyance of the recording medium 12 is resumed in timing with the conveyed toner images at the position of the secondary transfer roller 27, where the toner images are transferred onto the recording material (recording medium 12) from the intermediate transfer belt 30 by the secondary transfer roller 27.

Thereafter, after the toner images on the recording medium 12 are fixed by heating by a fixing roller pair 16 and 17, the recording medium 12 is output outside the apparatus. Here, toner that is not transferred from the intermediate transfer belt 30 to the recording medium 12 by the secondary transfer roller 27 is collected into a waste toner container 36 by a cleaning blade 35. The operation of a color-misregistration detection sensor 40 that detects toner images will be described later. The alphabetical characters, a, b, c, and d in the individual reference signs indicate yellow, magenta, cyan, and black configurations and units, respectively.

FIG. 1 illustrates a system in which light irradiation is performed by a scanner unit. However, the present invention is not limited thereto; for example, an image forming apparatus equipped with an LED array as a light irradiation unit may be applied to the following embodiments in the respect that color misregistration (positional misalignment) occurs. In the following embodiments, a case in which a scanner unit is provided as a light irradiation unit will be described by way of example.

Configuration Diagram of High-voltage Supply Unit

Figure 2:
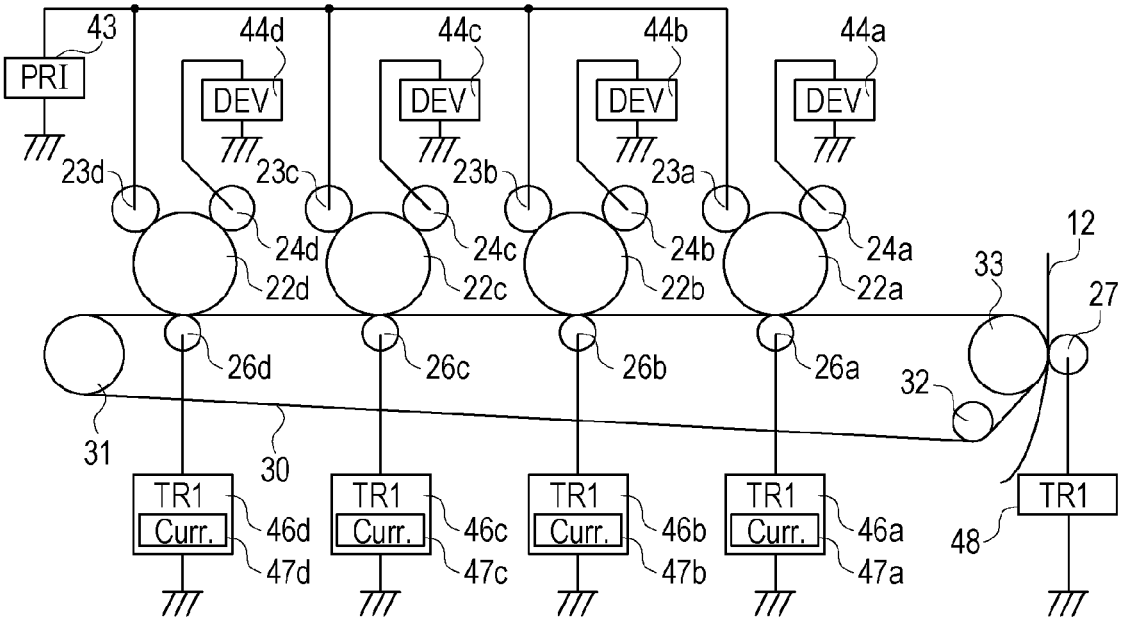
FIG. 2 is a diagram showing the configuration of a high-voltage supply unit.

Next, the configuration of a high-voltage supply unit of the image forming apparatus 10 in FIG. 1 will be described using FIG. 2. The high-voltage supply circuit unit includes a charging high-voltage supply circuit 43, developing high-voltage supply circuits 44*a* to 44*d*, primary-transfer high-voltage supply circuits 46*a* to 46*d*, and a secondary-transfer high-voltage supply circuit 48. The charging high-voltage supply circuit 43 applies a voltage to the charging rollers 23*a* to 23*d* to form background potential on the surfaces of the photosensitive drums 22*a* to 22*d*, thereby facilitating forming electrostatic latent images under irradiation of laser light. The developing high-voltage supply circuits 44*a* to 44*d* place toner on the electrostatic latent images on the photosensitive drums 22*a* to 22*d* to form toner images by applying a voltage to the developing sleeves 24*a* to 24*d*. The primary-transfer high-voltage supply circuits 46*a* to 46*d* applies a voltage to the primary transfer rollers 26*a* to 26*d* to thereby transfer the toner images on the photosensitive drums 22*a* to 22*d* to the intermediate transfer belt 30. The secondary-transfer high-voltage supply circuit 48 applies a voltage to the secondary transfer roller 27 to thereby transfer the toner images on the intermediate transfer belt 30 to the recording medium 12. The primary-transfer high-voltage supply circuits 46*a* to 46*d* include electrical-current detection circuits 47*a* to 47*d*, respectively. This is because the toner-image transfer performance of the primary transfer rollers 26*a* to 26*d* changes depending on the amount of electrical current flowing through the primary transfer rollers 26*a* to 26*d*. The primary-transfer high-voltage supply circuits 46*a* to 46*d* are configured to adjust bias voltages (high voltages) to be applied to the primary transfer rollers 26*a* to 26*d* depending on the detection results of the electrical-current detection circuits 47*a* to 47*d* so that the transfer performance can be kept constant even if the temperature and humidity in the apparatus change. During primary transfer, constant voltage control is performed to attain a bias voltage that is set so that the amounts of electric current flowing through the primary transfer rollers 26*a* to 26*d* attain a target value.

Hardware Block Diagram of Printer System

Figure 3:
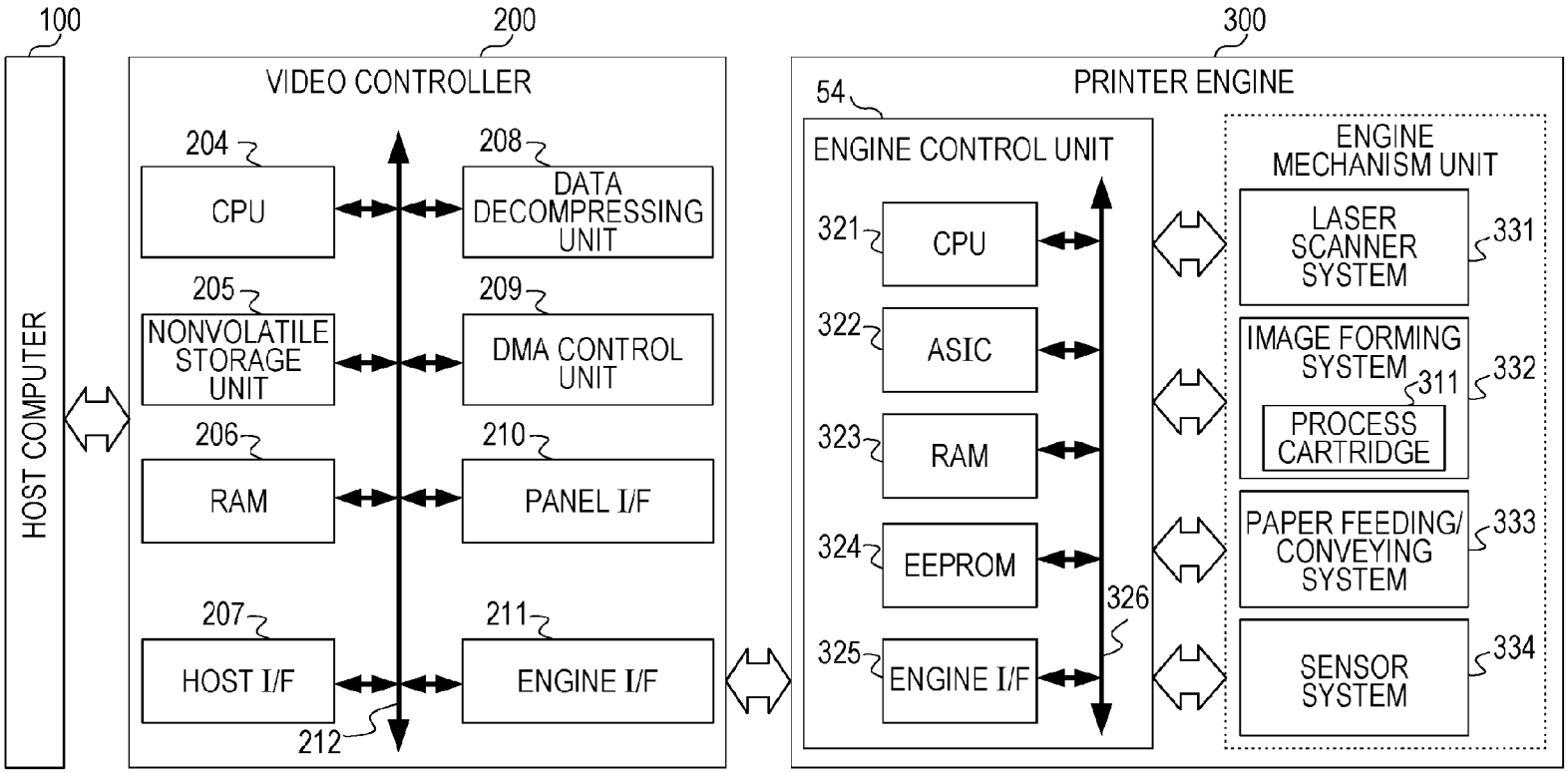
FIG. 3 is a block diagram of the hardware configuration of a printer system.

Next, a general hardware configuration of a printer system will be described using FIG. 3. First, a video controller 200 will be described. Reference numeral 204 denotes a CPU that takes charge of control of the entire video controller 200. Reference numeral 205 denotes a nonvolatile storage unit that stores various control codes that the CPU 204 implements and corresponds to a ROM, an EEPROM, a hard disk, etc. Reference numeral 206 denotes a RAM for temporary storage serving as a main memory, a work area, etc. of the CPU 204.

Reference numeral 207 denotes a host interface (in FIG. 3, referred to as a host I/F), which is an input/output unit for print data and control data to/from an external device 100, such as a host computer. Print data received via the host interface 207 is stored as compressed data in the RAM 206. Reference numeral 208 denotes a data decompressing unit for expanding the compressed data. Any compressed data stored in the RAM 206 is expanded in units of line. The expanded image data is stored in the RAM 206.

Reference numeral 209 denotes a direct memory access (DMA) control unit. The DMA control unit 209 transfers image data in the RAM 206 to an engine interface 211 (in FIG. 3, referred to as an engine I/F) according to an instruction from the CPU 204. Reference numeral 210 denotes a panel interface (in FIG. 3, referred to as a panel I/F), which receives various settings and instructions of the operator from a panel provided on the printer main body 1. Reference numeral 211 denotes the engine interface (in FIG. 3, referred to as an engine I/F), which transmits a data signal from an output buffer register (not shown) and performs control of communication with a printer engine 300. Reference numeral 212 denotes a system bus including an address bus and a data bus. The foregoing components are connected to the system bus 212, thus being accessed each other.

Next, the printer engine 300 will be described. The printer engine 300 is roughly divided into an engine control unit 54 (hereinafter, simply referred to as a control unit 54) and an engine mechanism unit. The engine mechanism unit is a unit operated according to various instructions from the control unit 54. First, the details of the engine mechanism unit will be described, and next, the details of the control unit 54 will be described.

A laser scanner system 331 includes a laser-light emitting device, a laser driver circuit, a scanner motor, a polygonal mirror, and a scanner driver. The laser scanner system 331 forms latent images on the photosensitive drums 22 by exposing the photosensitive drums 22 to laser beams in accordance with image data sent from the video controller 200. The laser scanner system 331 and an image forming system 332, to be described next, correspond to the unit referred to as the image forming unit, described with reference to FIG. 1.

The image forming system 332 is a unit that forms the nucleus of the image forming apparatus and forms toner images based on latent images formed on the photosensitive drums 22 on a sheet (recording medium 12). The image forming system 332 includes the processing units (the plurality of kinds of processing unit), described above, that act on the photosensitive drums 22. The image forming system 332 includes processing components, such as a process cartridge 311, the intermediate transfer belt 30, and a fixing unit, and the high-voltage supply circuits that generate various biases (high voltages) for forming images. The image forming system 332 further includes motors for driving the components, such as motors for driving the photosensitive drums 22.

The process cartridge 311 includes a static eliminator, the charging unit 23 (charging roller 23), the developing unit 25, and the photosensitive drums 22. The process cartridge 311 is equipped with nonvolatile memory tags. The CPU 321 or the ASIC 322 reads and writes various items of information from/to the memory tag.

A paper feeding/conveying system 333 is a system that takes charge of feeding/conveying a sheet (recording medium 12) and includes various conveying-system motors, a paper feed tray, a paper output tray, various conveying rollers (discharge rollers).

A sensor system 334 is a sensor group for collecting information necessary for the CPU 321 and the ASIC 322, to be described later, to control the laser scanner system 331, the image forming system 332, and the paper feeding/conveying system 333. The sensor group includes at least various known sensors, such as a fixing-unit temperature sensor and a concentration sensor for detecting the density of images. This sensor group also includes the color-misregistration detection sensor 40 for detecting toner images, described above. Although the sensor system 334 in the drawing is separated from the laser scanner system 331, the image forming system 332, and the paper feeding/conveying system 333, the sensor system 334 may be included in any of the systems.

Next, the control unit 54 will be described. Reference numeral 321 denotes a CPU, which controls the engine mechanism unit, described above, in accordance with various control programs stored in the EEPROM 324 using the RAM 323 as a main memory and a work area. More specifically, the CPU 321 operates the laser scanner system 331 on the basis of a print control command and image data input from the video controller 200 via the engine I/F 211 and the engine I/F 325. A volatile memory with a backup battery may be used as an alternative to a nonvolatile memory. The CPU 321 controls various print sequences by controlling the image forming system 332 and the paper feeding/conveying system 333. The CPU 321 acquires necessary information for controlling the image forming system 332 and the paper feeding/conveying system 333 by operating the sensor system 334.

On the other hand, the ASIC 322 performs control of the individual motors and high-voltage supply control of bias voltages etc. for executing the various print sequences, described above, under instructions from the CPU 321. Reference numeral 326 denotes a system bus including an address bus and a data bus. The components of the control unit 54 are connected by the system bus 326, thus being accessible to each other. Part or all of the functions of the CPU 321 may be performed by the ASIC 322, or conversely, part or all of the ASIC 322 may be performed by the CPU 321.

Circuit Diagram of High-voltage Supply

Next, the circuit configuration of the primary-transfer high-voltage supply circuit 46*a* of the high-voltage supply unit in FIG. 2 will be described using FIG. 4. Descriptions of the primary-transfer high-voltage supply circuits 46*b* to 46*d* of the other colors will be omitted because they have the same circuit configuration.

Figure 4:
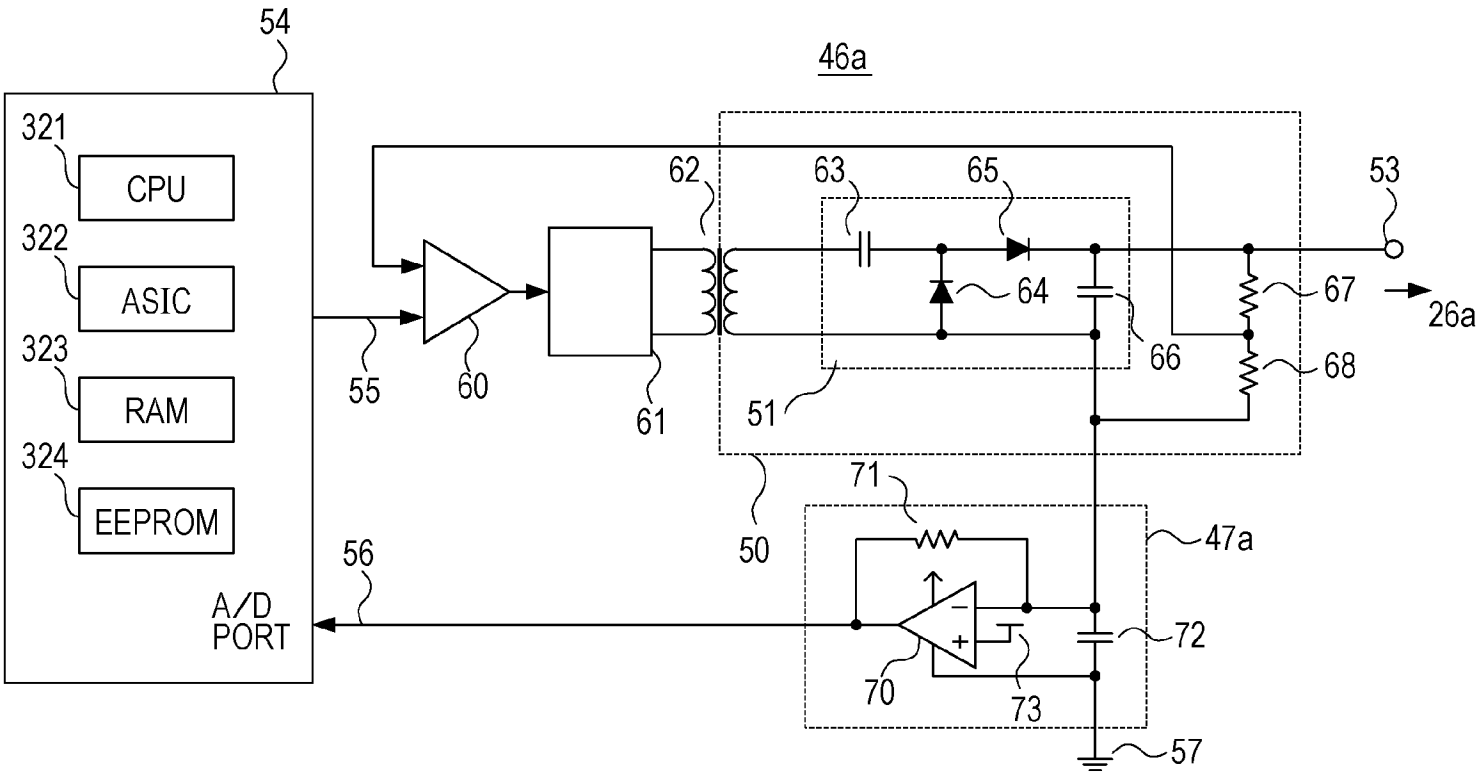
FIG. 4 is a diagram of a high-voltage supply circuit.

In FIG. 4, a transformer 62 increases the amplitude of the voltage of an alternating current signal generated by a drive circuit 61 by tens times. A rectifying circuit 51 constituted by diodes 64 and 65 and capacitors 63 and 66 rectifies and smoothes the boosted alternating current signal. The rectified and smoothed alternating current signal is output to an output terminal 53 as a direct current voltage. A comparator 60 controls the output voltage of the drive circuit 61 so that the voltage of the output terminal 53 divided by detecting resistors 67 and 68 and a voltage set value 55 set by the control unit 54 become equal. An electric current flows via the primary transfer roller 26*a*, the photosensitive drum 22*a*, and the ground in accordance with the voltage of the output terminal 53.

Here, the electrical-current detection circuit 47 is placed between a secondary side circuit 50 and a ground point 5. Since an input terminal of an operational amplifier 70 has high impedance, so that little electric current flows, the electrical-current detection circuit 47 is configured such that substantially all of a direct current flowing from the ground point 57 to the output terminal 53 through the secondary side circuit 50 of the transformer 62 flows to a resistor 71. Since the inverting input terminal of the operational amplifier 70 is connected to an output terminal via the resistor 71 (negatively fed back), the inverting input terminal is virtually grounded to a reference voltage 73 connected to a non-inverting input terminal. Accordingly, a detection voltage 56 proportional to the amount of an electric current flowing to the output terminal 53 appears at the output terminal of the operational amplifier 70. In other words, when an electric current flowing to the output terminal 53 changes, an electric current flowing via the resistor 71 changes in such a manner that the detection voltage 56, not at the inverting input terminal of the operational amplifier 70, but at the output terminal of the operational amplifier 70 changes. A capacitor 72 is a device for stabilizing the inverting input terminal of the operational amplifier 70.

The current characteristics of the primary transfer rollers 26*a* to 26*d* change depending on factors, such as the degradation levels of the components and the temperature in the apparatus. Therefore, the control unit 54 measures the detected value 56 (detection voltage 56) of the electrical-current detection circuit 47 at an A/D input port at the timing directly after printing is started and before a toner image reaches the primary transfer roller 26*a* and sets the voltage set value 55 so that the detected value 56 becomes a predetermined value. This allows toner-image transfer performance to be kept constant even if the ambient temperature, humidity, etc. change.

Description of Color-misregistration Correction Control

With the above-described image forming apparatus, first, marks for detecting color misregistration are formed on the intermediate transfer belt 30 to reduce the amount of color misregistration. After the color misregistration is eliminated (at least, reduced), the time at which an electrostatic latent image 80 reaches the position of the primary transfer roller 26*a* is measured by detecting a change in a primary transfer current, and the measured time is set as a reference value for the color-misregistration correction control.

In color-misregistration correction control that is performed when the temperature in the apparatus has changed during continuous printing etc., a change in the primary transfer current is detected again, and the time at which the electrostatic latent image 80 reaches the position of the primary transfer roller 26*a* is measured. A change in the measured arrival time reflects the amount of color misregistration. Accordingly, the timing at which the scanner unit 20*a* emits the laser beam 21*a* is adjusted to cancel the change during printing to correct the color misregistration. A detailed description will be made hereinbelow. Control of image formation conditions for color misregistration correction is not limited to control of light irradiation timing. For example, speed control of the photosensitive drums 22 or mechanical position control of reflecting mirrors in the scanner units 20*a* to 20*d* are also possible.

Flowchart for Reference-value Obtaining Processing

Figure 5:
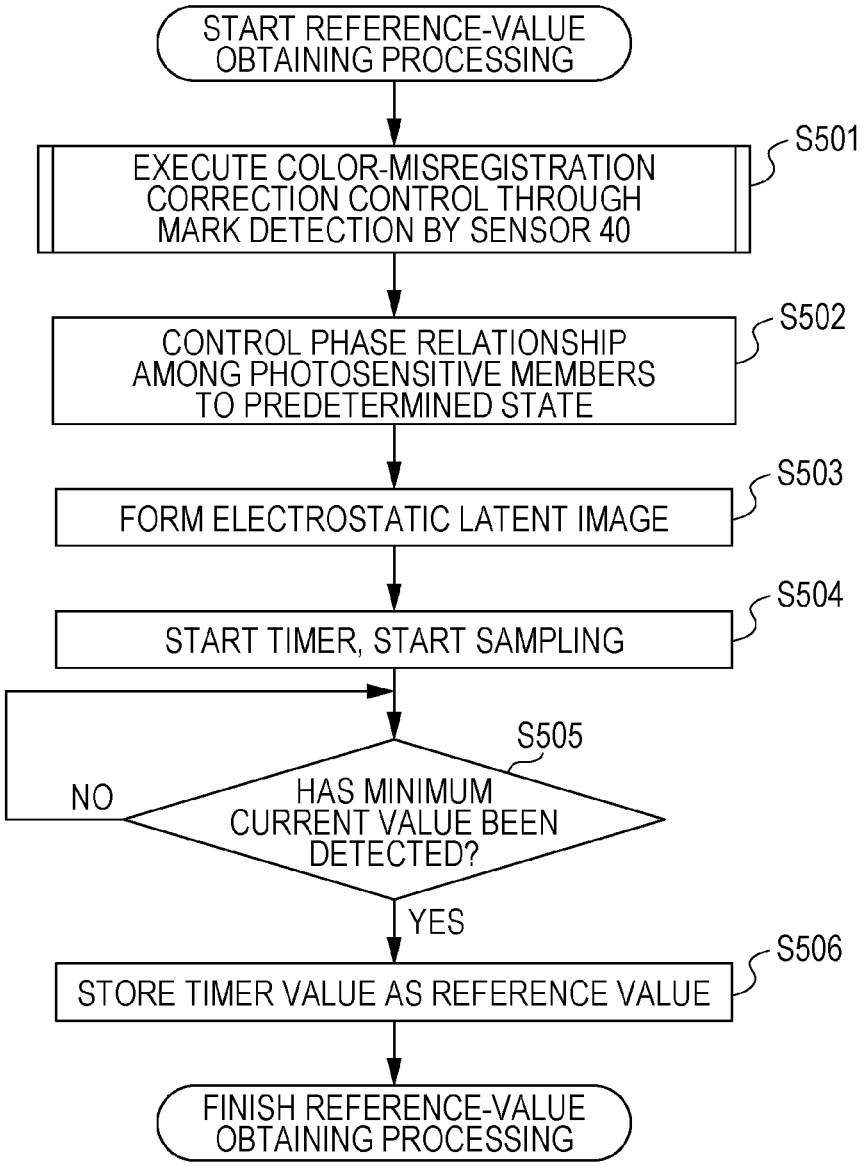
FIG. 5 is a flowchart for reference-value obtaining processing.

A flowchart in FIG. 5 is a flowchart showing reference-value obtaining processing in the color-misregistration correction control. First, the flowchart in FIG. 5 is performed after color-misregistration correction control is performed by means of detection of marks with the color-misregistration detection sensor 40 (toner-image detecting unit) (FIG. 6) (hereinafter referred to as ordinary color-misregistration correction control). The flowchart of FIG. 5 may be executed only for ordinary color-misregistration correction control at specified timing, such as when the ordinary color-misregistration correction control is executed after a component, such as the photosensitive drum 22 and the developing sleeve 24, is replaced. The flowchart of FIG. 5 is performed independently for the individual colors. The color-misregistration detection sensor 40 includes a light emitting device, such as an LED, and is configured to emit light with the light emitting device onto a color-misregistration detecting toner image formed on the belt 30 and detect a change in the quantity of reflected light as the position of the toner image (detection timing). Since this is a known technology described in many literatures, a detailed description will be omitted here.

Figure 6:
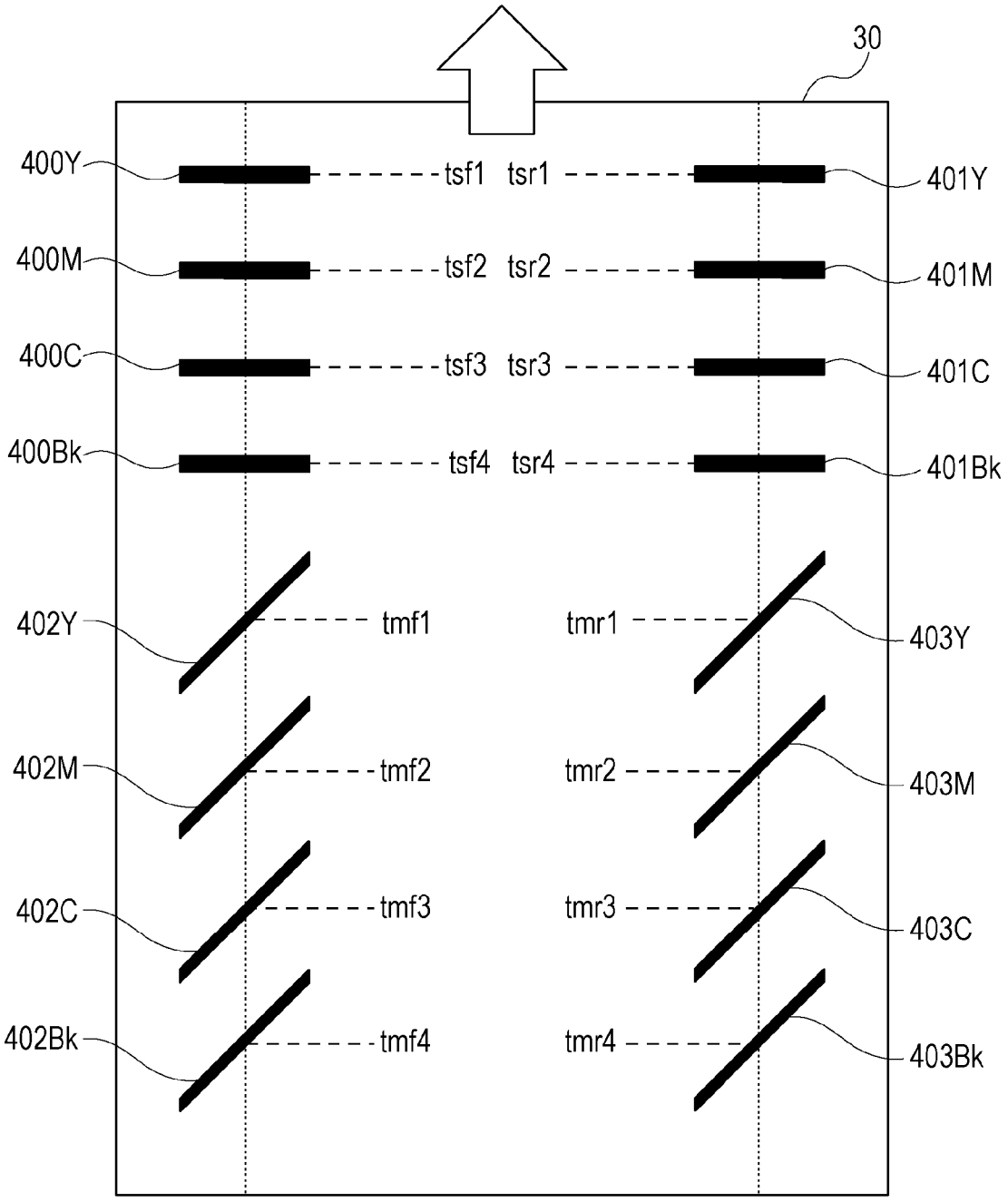
FIG. 6 is a diagram illustrating an example of color misregistration detecting marks (for color misregistration correction) formed on an intermediate transfer belt.

FIG. 5 will be described. In step S501, the control unit 54 forms toner marks for detecting color misregistration on the intermediate transfer belt 30 with the image forming unit. Since this color-misregistration detecting toner marks are toner images used to correct color misregistration, it can also be referred to as color-misregistration correcting toner images. FIG. 6 shows a state in which the color-misregistration detecting toner marks are formed. By the processing in step S501, a state in which the amount of color misregistration is at least reduced can be set to a target value of the color-misregistration correction control, that is, a basic state, for the following control using electrostatic latent images for correcting color misregistration.

In FIG. 6, reference numerals 400 and 401 denote patterns for detecting the amount of color misregistration in a sheet conveying direction (subscanning direction). Reference numerals 402 and 403 denote patterns for detecting the amount of color misregistration in a main scanning direction perpendicular to the sheet conveying direction, which are, in this example, inclined at 45 degrees. Reference numerals tsf1 to tsf4, tmf1 to tmf14, tsr1 to tsr14, and tmr1 to tmr4 denote the detection timings of the individual patterns, and the arrow indicates the moving direction of the intermediate transfer belt 30.

Assume that the moving speed of the intermediate transfer belt 30 is v mm/s, the reference color is Y, and the theoretical distances between the Y-patterns (400Y and 401Y) and the other color patterns (400M, 400C, and 400B and 401M, 401C, and 401B) in the sheet conveying direction are dsM mm, dsC mm, and dsBk mm, respectively. The amounts of color misregistration, δes, of the individual colors M, C, and Bk relative to the reference color Y in the conveying direction are expressed as the following (Eq. 1] to [Eq. 3].

$$\delta esM = v \times \{(tsf2 - tsf1) + (tsr2 - tsr1)\}/2 - dsM \quad \text{Eq. 1}$$

$$\delta esC = v \times \{(tsf3 - tsf1) + (tsr3 - tsr1)\}/2 - dsC \quad \text{Eq. 2}$$

$$\delta esBk = v \times \{(tsf4 - tsf1) + (tsr4 - tsr1)\}/2 - dsBk \quad \text{Eq. 3}$$

For the main scanning direction, the amounts of positional misalignment of the colors M, C, and Bk at the right and left, δemf and δemr, are expressed as follows:

$$\delta emfM = dmfM - dmfY \quad \text{Eq. 12}$$

$$\delta emfC = dmfC - dmfY \quad \text{Eq. 13}$$

$$\delta emfBk = dmfBk - dmfY \quad \text{Eq. 14}$$

and $$\delta emrM = dmrM - dmrY \quad \text{Eq. 15}$$

$$\delta emrC = dmrC - dmrY \quad \text{Eq. 16}$$

$$\delta emrBk = dmrBk - dmrY\,v \quad \text{Eq. 17}$$

from $$dmfY=v\times(tmf1-tsf1) \quad \text{Eq. 4}$$

$$dmfM=v\times(tmf2-tsf2) \quad \text{Eq. 5}$$

$$dmfC=v\times(tmf3-tsf3) \quad \text{Eq. 6}$$

$$dmfBk=v\times(tmf4-tsf4) \quad \text{Eq. 7}$$

and $$dmrY=v\times(tmr1-tsr1) \quad \text{Eq. 8}$$

$$dmrM=v\times(tmr2-tsr2) \quad \text{Eq. 9}$$

$$dmrC=v\times(tmr3-tsr3) \quad \text{Eq. 10}$$

$$dmrBk=v\times(tmr4-tsr4) \quad \text{Eq. 11}$$

The direction of misalignment can be determined depending on whether the calculation results are positive or negative, and the writing position is corrected using δemf, and the main scanning width (main scanning magnification) is corrected using δemr−δemf. If the main scanning width (main scanning magnification) has an error, the writing position is calculated using not only δemf but also the amount of change in image frequency (image clock) that has changed due to correction in the main scanning width.

The control unit 54 changes the laser-beam emission timing of the scanner unit 20*a*, which is an image formation condition, so as to correct the calculated color misregistration amount. For example, if the amount of color misregistration in the subscanning direction is an amount corresponding to <4 lines, the control unit 54 instructs the video controller 200 to speed up laser beam emission timing by an amount corresponding to +4 lines.

Although FIG. 6 illustrates the case where color-misregistration detecting toner marks are formed on the intermediate transfer belt 30, various forms are possible for the positions of the color-misregistration detecting toner marks to be detected by the optical sensor (color-misregistration detection sensor 40). For example, the color-misregistration detecting toner marks may be formed on the photosensitive drums 22, and detection results of color-misregistration detection sensors (optical sensors) disposed so as to detect the toner marks may be used. Alternatively, the color-misregistration detecting toner marks may be formed on a sheet (recording material), and detection results of a color-misregistration detection sensor (optical sensor) disposed so as to detect the toner marks may be used. It is supposed that the color-misregistration detecting toner marks are formed on various transferred members or toner-image bearing members.

Referring back to the flowchart in FIG. 5, in step S502, the control unit 54 controls the rotational phase relationship (rotational position relationship) among the photosensitive drums 22*a* to 22*d* to a predetermined state so as to reduce an influence when the rotational speeds (peripheral speeds) of the photosensitive drums 22*a* to 22*d* change. Specifically, the phases of photosensitive drums of the other colors are adjusted to the phase of a photosensitive drum of a reference color under the control of the control unit 54. In the case where photosensitive-drum drive gears are provided on the shafts of the photosensitive drums 22, the phase relationship among the photosensitive-drum drive gears is adjusted. This makes the rotational speeds of the photosensitive drums 22 when toner images developed on the individual photosensitive drums 22 are transferred onto the intermediate transfer belt 30 substantially the same or a similar speed change tendency. Specifically, the control unit 54 issues a speed control instruction to motors (not shown) that drive the photosensitive drums 22 to bring the rotational phase relationship among the photosensitive drums 22*a* to 22*d* to a predetermined state. If the change in the rotational speed of the photosensitive drums 22 is negligible, the processing in step S502 may be omitted.

In step S503, the control unit 54 causes the scanner units 20*a* to 20*d* to emit laser beams onto the rotating photosensitive drums 22 at a predetermined rotation phase to form electrostatic latent images for correcting color misregistration on the photosensitive drums 22.

Figure 7:
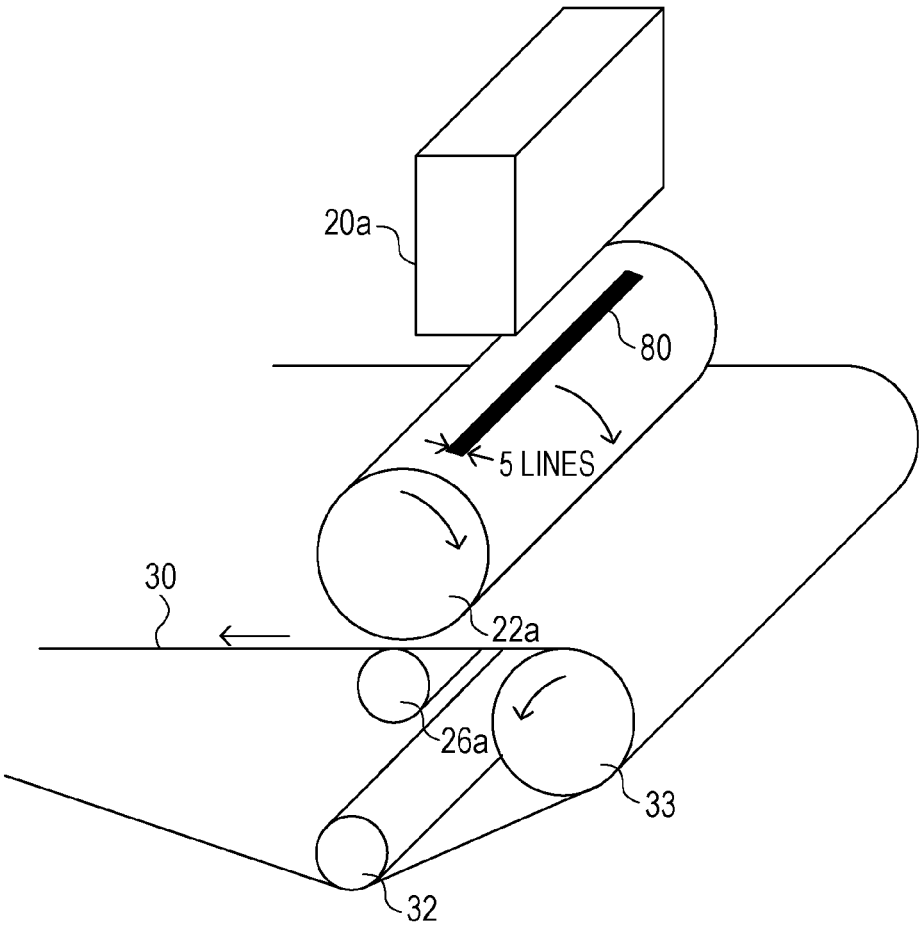
FIG. 7 is a diagram illustrating a state in which an electrostatic latent image for detecting color misregistration is formed on a photosensitive drum.

FIG. 7 is a diagram illustrating a state in which an electrostatic latent image is formed on the photosensitive drum 22*a* using a yellow photosensitive drum 22*a*. In the drawing, reference numeral 80 denotes the formed electrostatic latent image. The electrostatic latent image 80 is drawn at the maximum width of the image area width in the main scanning direction and has a width corresponding to about five lines in the conveying direction. Preferably, the width in the main scanning direction is greater than or equal to half of the maximum width in terms of obtaining a good detection result. More preferably, the width of the electrostatic latent image 80 is increased in an area exceeding the sheet area outside the image area (a print image area on a sheet) in which an electrostatic latent image can be formed. In this case, for example, by placing the developing sleeve 24*a* apart from the photosensitive drum 22*a* (separated state), the electrostatic latent image 80 can be conveyed to the position of the primary transfer roller 26*a* without toner attached. Adhesion of toner may be prevented by bringing the voltages output from the developing bias high-voltage supply circuits 44*a* to 44*d* to zero or by applying a bias opposite in polarity to a normal bias under an instruction from the control unit 54. The developing sleeve 24*a*, which is disposed upstream of the primary transfer roller 26*a* in the photosensitive-drum rotating direction, needs to be separated or to be operated so that an action on the photosensitive drum 22*a* is smaller than that during normal toner image formation with the image forming unit.

The control unit 54 starts timers prepared for the individual YMCK at the same time or substantially the same time as the processing in step S503 (step S504). Furthermore, sampling of the detected value of the electrical-current detection circuit 47*a* is started. The sampling frequency at that time is, for example, 10 kHz.

Figure 8:
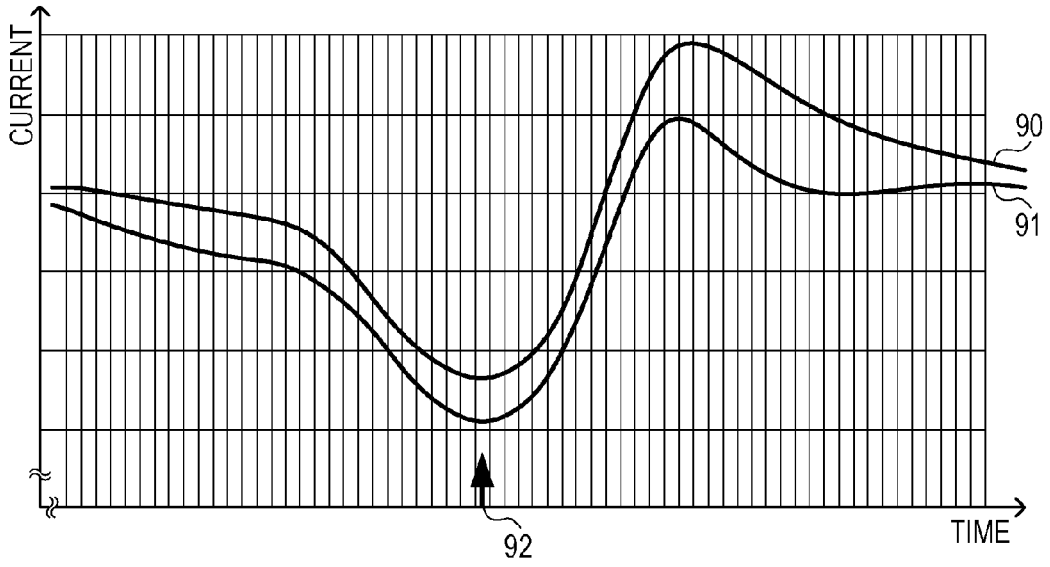
FIG. 8 is a diagram showing an example of the detection result of surface potential information of a photosensitive drum.

In step S505, the control unit 54 measures the time (timer value) at which the detected value of the primary transfer current becomes minimum by detecting the electrostatic latent image 80 on the basis of the data obtained by the sampling in step S503. This measurement allows passage of the electrostatic latent image 80 formed on the photosensitive drums 22*a* to a position facing the first transfer roller 26*a* to be detected. FIG. 8 shows an example of the detection result. The position facing the first transfer roller 26*a* is a position (area) in which a current change occurs due to the arrival of the electrostatic latent image 80. For example, the region of a slight gap (clearance) upstream or downstream of a nip between the photosensitive drum 22 and the intermediate transfer belt 30 corresponds to this position. The movement of the electrostatic latent image 80 to a region at which the photosensitive drum 22 and the intermediate transfer belt 30 are mechanically in contact sometimes contributes to a detected current change. The contribution to the detected current due to the movement of the electrostatic latent image 80 to the gap (clearance) region and the contribution to the detected current due to the movement of the electrostatic latent image 80 to the mechanically contact region are sometimes concurrent.

FIG. 8 illustrates output values for the potential on the surface of the photosensitive member (photosensitive drum 22*a*) from the electrical-current detection circuit 47*a* when the electrostatic latent image 80 has reached the primary transfer roller 26*a* serving as the processing unit. The information in FIG. 8 corresponds to the surface potential of the photosensitive drum 22*a*, and thus, it can be referred to as surface potential information of the photosensitive drum 22*a* in this respect, which will be described in detail in FIGS. 9A and 9B. FIG. 8 plots detected current in ordinate and time in abscissa, in which a scale unit in abscissa is the time during which the laser scanner scans one line. Waveforms 90 and 91 are obtained by measurement at different timings. Either of the waveforms 90 and 91 exhibits a characteristic that the currents become minimum after the electrostatic latent image 80 reaches the primary transfer roller 26*a* at time 92 and are thereafter recovered.

Figure 9A:
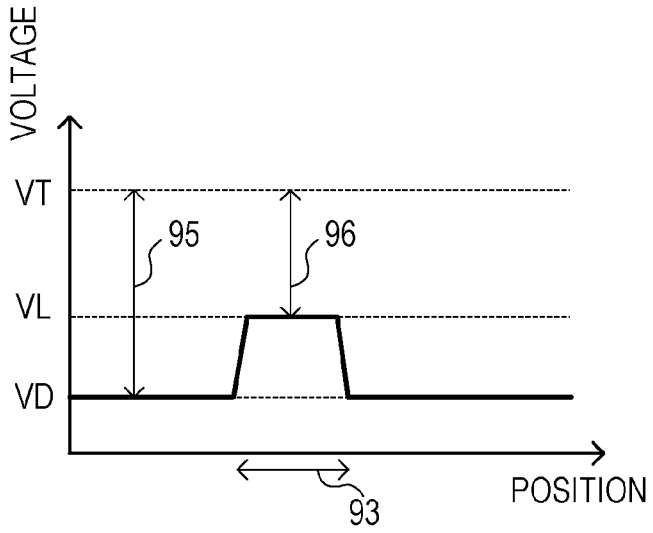
FIG. 9A is a schematic diagram showing the surface potential of a photosensitive drum at charging or exposure setting for normal image output.

The reason that the detected current values decrease will be described. FIG. 9A is a schematic diagram showing the surface potential of the photosensitive drum 22*a*. The horizontal axis is scaled in terms of the surface position of the photosensitive drum 22*a* in the conveying direction, and area 93 is a position at which the electrostatic latent image 80 is formed. The vertical axis is scaled in terms of potential, where VD is the dark potential of the photosensitive drum 22*a* (for example, −700 V), VL is the light potential (for example, −100 V), and VT is the transfer bias potential of the primary transfer roller 26*a* (for example, +1.0 kV).

Figure 9B:
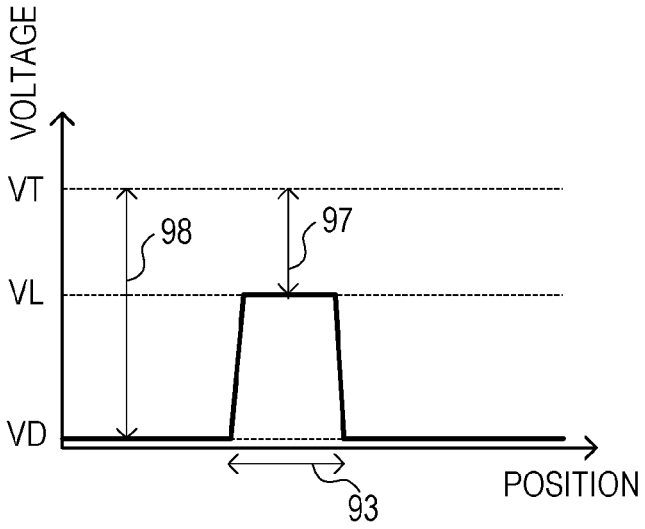
FIG. 9B is a schematic diagram showing the surface potential of the photosensitive drum at charging or exposure setting changed for color-misregistration correction control.

In an area 93 of the electrostatic latent image 80, a potential difference 96 between the primary transfer roller 26*a* and the photosensitive drum 22*a* is smaller than a potential 95 of the other area. Therefore, when the electrostatic latent image 80 reaches the primary transfer roller 26*a*, an electric current flowing through the primary transfer roller 26*a* decreases. This is the reason that the minimum value in FIG. 8, described above, is detected. Thus, the detected current value reflects the surface potential of the photosensitive drum 22*a*. FIGS. 9A and 9B illustrate the difference between the surface potential of the photosensitive drum 22 and the output voltage of the primary transfer roller 26*a* by way of example. For the change in the amount of electric current, the same applies to the surface potential of the photosensitive drum 22 and a charging voltage or developing voltage.

Referring back to the flowchart in FIG. 5, finally in step S506, the control unit 54 stores the time (timer value) measured in step S505 in the EEPROM 324 as a reference value. The stored information shows a target reference state in performing color-misregistration correction control. The control unit 54 performs color-misregistration correction control so as to eliminate displacement from the reference state, in other words, to recover the reference state.

Here, the timer value obtained in step S506 is based on (with reference to) the timing at which the electrostatic latent images 80 are formed by the scanner units 20*a* to 20*d* in step S503. That the timer value is based on the timing at which the electrostatic latent images 80 are formed means that the timing may be not only the timing at which the electrostatic latent images 80 are formed but also timing related to the timing at which the electrostatic latent images 80 are formed, for example, one second before the electrostatic latent images 80 are formed. The EEPROM 324 may be a RAM with a backup battery, for example. The time information to be stored need only specify time, for example, information of second and a clock count.

In the flowchart, although the ordinary color-misregistration correction control is followed by minimum current value detection, the minimum current value detection may be executed before the ordinary color-misregistration correction control.

First, the time at which the electrostatic latent image 80 reaches the primary transfer roller 26*a* is determined by detecting the minimum current value. Thereafter, a change in laser-beam emission timing with which color misregistration in the subscanning direction can be corrected by the ordinary color-misregistration correction control is obtained. The reference value may be calculated from the arrival time and the change in time. Accordingly, the two execution timings may be substantially the same.

Detailed Description of Step S505

Here, the reason that it is desirable to measure the time the detected waveforms (current waveforms) 90 and 91 in FIG. 8 become minimum will be described. This is because even if the absolute values of measured currents, like the detected waveforms (electric current waveforms) 90 and 91, differ, the timing at which the electrostatic latent image 80 reaches the primary transfer roller 26*a* can be accurately measured. The reason that the detecting pattern (color-misregistration correcting electrostatic latent image) is shaped like the electrostatic latent image 80 in FIG. 7 is that a change in current value can be increased owing to the pattern that is wide in the main scanning direction. Since the electrostatic latent image 80 has a width corresponding to several lines in the conveying direction (subscanning direction) of the photosensitive drum 22*a*, a peak at which the current value becomes minimum appears while keeping the great change in current value. Accordingly, an optimum shape of the electrostatic latent image 80 differs depending on the configuration of the apparatus and is not limited to the shape having a width corresponding to five lines in the conveying direction, as in this embodiment.

The detection results shown in FIG. 8 are desirable; instead, by forming the electrostatic latent image 80 corresponding to 20 lines larger than the five lines in the conveying direction, a flat area is formed in the detection result, and a midpoint thereof may be detected. That is, a position that matches the specified condition (characteristic point) detected in the flowchart of FIG. 5 may be detected from the detection result when a flowchart in FIG. 11, described later, is executed. Such a form allows not only the foregoing minimum current position but also characteristic positions of various detection results to be applied to the determination target in step S505 in FIGS. 5 and 11. This also applies to FIGS. 13 and 14, described later.

Here, when a minimum current value is detected for acquisition of a reference value or color-misregistration correction control, there is no need to set charging bias conditions and developing conditions the same as those for normal image output during which an image is output when print data is transmitted from the external device 100, such as a host computer. The various charging bias conditions and developing conditions for the normal image output are set to achieve an optimum toner amount on the sheet. If the conditions differ from the setting, the amount of toner on the sheet increases, resulting in a possibility that image defects, such as spattering and poor fixing, can occur. However, since this is regardless of acquisition of a reference value and for color-misregistration correction control, the setting may be changed to setting for detecting a minimum current value at high accuracy.

FIG. 9A is a schematic diagram showing the surface potential of the photosensitive drum 22*a* during normal image output. In contrast, FIG. 9B is a schematic diagram showing the surface potential of the photosensitive drum 22*a* during color-misregistration correction control of this embodiment. The same components as those in FIG. 9A are given the same reference numerals, and descriptions thereof will be omitted. Control during color-misregistration correction control will be described hereinbelow.

[1] The absolute value of a charging high voltage applied from the charging high-voltage supply circuit 43 to the charging roller 23*a* is set to a value larger than that for normal image formation. That is, the output intensity of the charging roller 23*a* is increased. For example, in a contact DC charging system, if the normal charging high voltage is (−1.0 kV), the high voltage applied in this embodiment is (−1.2 kV). Thus, the absolute value of the VD (the dark potential of the photosensitive drum 22*a*) becomes larger than that during the normal image formation. In the case of another charging system, such as a contact AC charging system, if a normal charging high voltage Vdc (for an AC voltage waveform) is (−500 V), the voltage applied in this embodiment is (−700 V).

[2] The light intensity of the laser beam 21*a* emitted from the scanner unit 20*a* is set to a value larger than that during normal image formation. That is, the output intensity of the scanner unit 20*a* is increased. For example, if a normal laser emission intensity is 0.175 mW, the light intensity of the laser beam 21*a* in this embodiment is 0.21 mW. Thus, the absolute value of the VL (the light potential of the photosensitive drum 22*a*) is decreased.

If the settings of VD and VL are changed from those of normal image formation to those in (1) and (2) described above, a potential difference 97 between the primary transfer roller 26*a* and the photosensitive drum 26*a* in the area corresponding to the electrostatic latent image 80 is decreased as compared with the potential difference 96 during normal image formation. A potential difference 98 in the other area is increased as compared with the potential difference 96 during normal image formation. That is, the potential change between the area 93 of the electrostatic latent image 80 and the other area becomes larger than that during normal image formation, thus allowing the area 93 to be detected more clearly.

Figure 10:
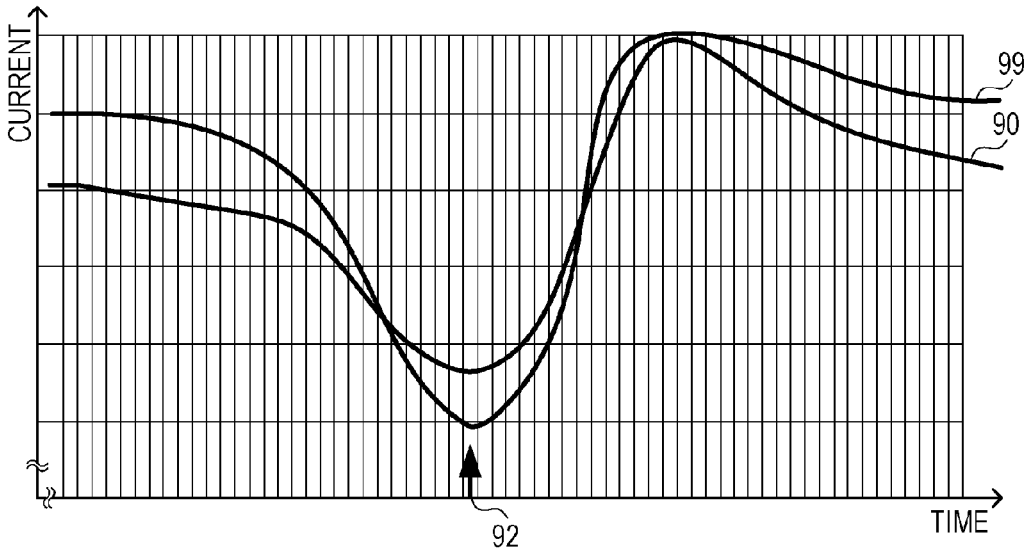
FIG. 10 is a diagram showing a comparison between the detection result of surface potential information of a photosensitive drum at charging or exposure setting for normal image output and the detection result of surface potential information of the photosensitive drum at charging or exposure setting changed for color-misregistration correction control.

FIG. 10 shows the detection results of the electrical-current detection circuit 47 at that time. In FIG. 10, a detected waveform 90 shows a detected waveform that is set for normal image formation. A detected waveform 99 shows a detected waveform in the case where VD and VL are changed as in (1) and (2) described above. The minimum current value becomes smaller at time 92 when the electrostatic latent image 80 reaches the primary transfer roller 26*a*. On the other hand, current values at the other areas become larger. That is, this allows the position of the electrostatic latent image 80 to be detected more clearly, thus allowing color misregistration correction to be executed more accurately.

In the above description, both the charging high voltage and the light intensity of the laser beam are increased; the same operation as that shown in FIG. 10 is confirmed also by increasing one of them, although to a small extent. Accordingly, also by controlling one of charging high voltage and the light intensity of the laser beam, the advantage of ease of detection can be obtained.

In the above description, the charging roller 23 is employed as the processing unit by way of example. Likewise, by changing a voltage applied to the developing unit (developing sleeve) or the primary transfer roller, serving as the processing unit, the same advantages can be achieved. For the developing unit, by increasing a charging apply voltage as for the charging roller, the same advantages can be provided. Also for the primary transfer roller, by increasing a transfer voltage applied, the potential difference 98 can be increased, thus further facilitating detecting a current change.

Flowchart for Color-misregistration Correction Control

Figure 11:
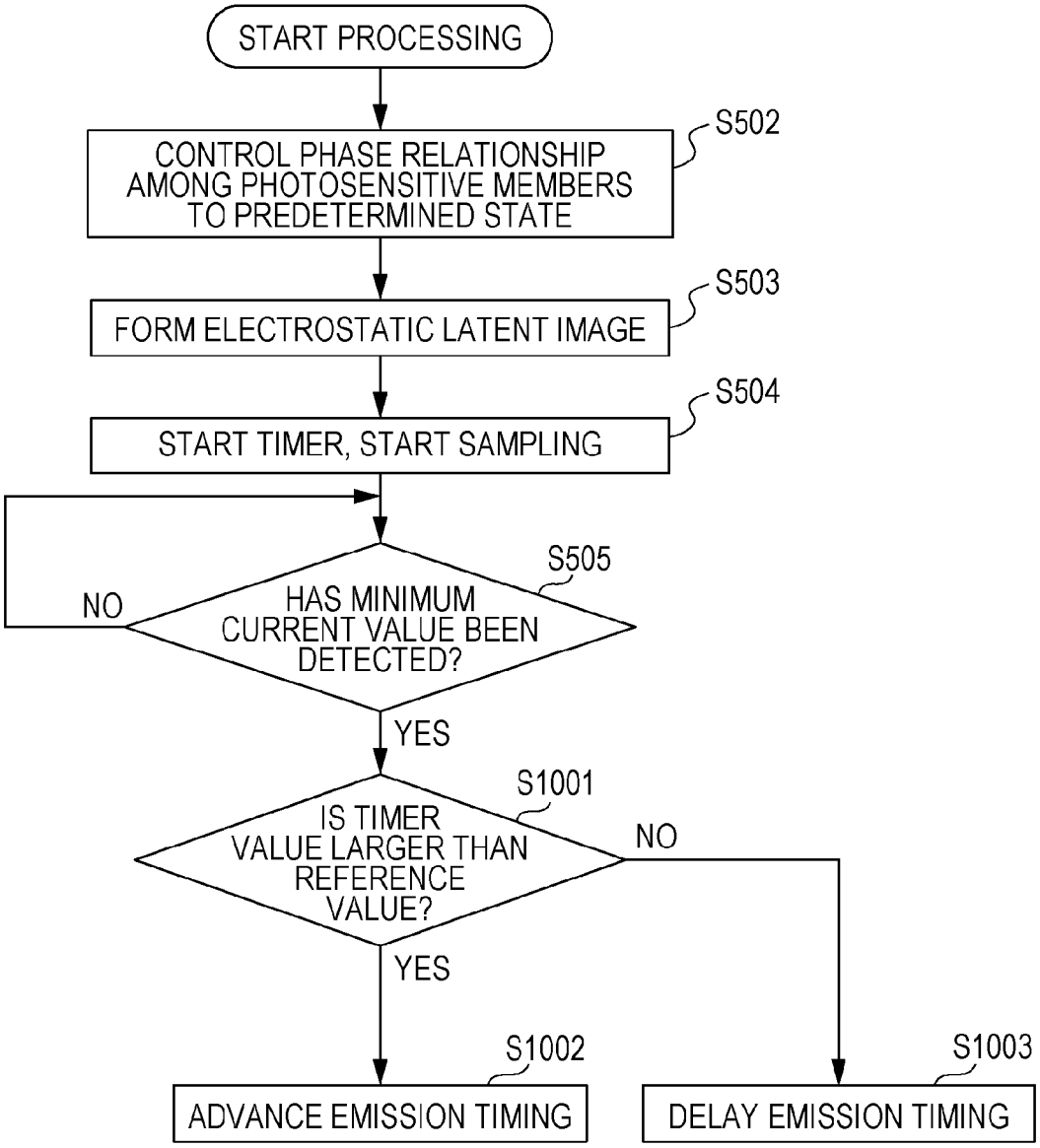
FIG. 11 is a diagram showing a flowchart of color-misregistration correction control.

Next, the color-misregistration correction control of this embodiment will be described with reference to a flowchart in FIG. 11. The flowchart in FIG. 11 is executed independently for the individual colors. The flowchart in FIG. 11 is executed under predetermined conditions, such as when the temperature in the apparatus has changed during continuous printing etc., when an instruction to execute color-misregistration correction control of FIG. 11 is input to the control unit 54 by user operation, or when the environment in the apparatus has significantly changed, as described above. This also applies to a flowchart in FIG. 14 etc. described later.

First, in steps S502 to S505, the same processing as those in FIG. 5 is performed. If the axis of the photosensitive drum 22*a* inclines, the time required for the electrostatic latent image 80 to reach the primary transfer roller 26*a*, described above, also changes. To detect the change, the electrostatic latent image 80 is formed at the same position as in step S503 of FIG. 5, also at step S503 in FIG. 11. The same position (phase) here may be strictly the same position or may be substantially or nearly the same position, provided that it is within a range in which the accuracy of color misregistration detection can be improved as compared with a case in which the electrostatic latent image 80 is formed at any position.

In step S1001, the control unit 54 compares a timer value at which a minimum current is detected with the reference value stored in step S506 of the flowchart of FIG. 5. If the timer value is larger than the reference value, then, in step S1002, the control unit 54 corrects the laser-beam emission timing, which is an image-formation condition, so as to speed up during printing. The degree of speed-up of the laser-beam emission timing by the control unit 54 may be adjusted depending on how much the measured time is larger than the reference value. On the other hand, if the timer value detected in step S1001 is smaller than the reference value, then, in step S1003, the control unit 54 delays the laser-beam emission timing during printing. The degree of delay of the laser-beam emission timing by the control unit 54 may be adjusted depending on how much smaller the measured time is than the reference value. The color misregistration correction is achieved by the image-formation-condition correcting processing in steps S1002 and S1003. That is, this allows the present color misregistration state to be returned to the reference color misregistration state (reference state).

Although, in step S1001 of the flowchart in FIG. 11, the control unit 54 compares the timer value at which a minimum current is detected with the reference value stored in step S506, the present invention is not limited thereto. In view of maintaining a color misregistration state at certain timing, steps S502 to S506 may be executed in any color-misregistration generated state, and the stored reference value may be used for comparison in step S1001. This also applies to FIGS. 13 and 14 described later.

Advantageous Effects of Invention

By executing the flowchart in FIG. 11 by the control unit 54, as described above, color-misregistration correction control can be achieved without transferring detecting toner images (100% in density) for color-misregistration correction control from the photosensitive drum to the image bearing member (belt). That is, color-misregistration correction control can be achieved while the usability of the image forming apparatus is kept as much as possible.

On the other hand, it is also known in the related art that the change tendency of the amount of color misregistration relative to the amount of change in the temperature in the apparatus is measured in advance, and the amount of color misregistration is estimated from the measured apparatus temperature, and then color-misregistration correction control is performed. This color-misregistration correction control method has an advantage in that there is no need to form detecting toner images on the image bearing member. However, although the color-misregistration correction control method of estimating the amount of color misregistration can reduce toner consumption, an actual color misregistration amount does not always agree with the estimated calculation result, and thus there is a problem of accuracy. In contrast, according to the flowchart in FIG. 11, the accuracy of color-misregistration correction control can be ensured to a certain degree while toner consumption can be reduced. By changing the charging bias conditions of developing conditions, the accuracy of color-misregistration correction control can be improved.

For the color-misregistration correction control using electrostatic latent images, for example, another form is also possible in which electrostatic latent images for correcting color misregistration are transferred onto the intermediate transfer belt, and a potential sensor for detecting the electrostatic latent images is provided. However, in this case, a standby time until the electrostatic latent images transferred onto the intermediate transfer belt are detected by the potential sensor occurs. In contrast, the foregoing embodiment can reduce the standby time, thus preventing reduction of the usability.

Furthermore, the method of transferring the electrostatic latent images for correcting color misregistration onto the intermediate transfer belt needs to keep the potential of the color-misregistration-correcting electrostatic latent images on the intermediate transfer belt until detection thereof. This requires increasing a time constant $\tau$ by, for example, using a belt material with high resistance ($e^{13}$ $\Omega$cm or more) so that the electric charge on the belt is not discharged in an instant (for example, 0.1 seconds). However, the intermediate transfer belt having a large time constant $\tau$ has the disadvantage that image defects, such as ghost and discharge marks due to belt charge-up, are prone to occur. In contrast, the foregoing embodiment can decrease the time constant $\tau$ of the intermediate transfer belt and can reduce image defects due to charge-up.

Figure 12:
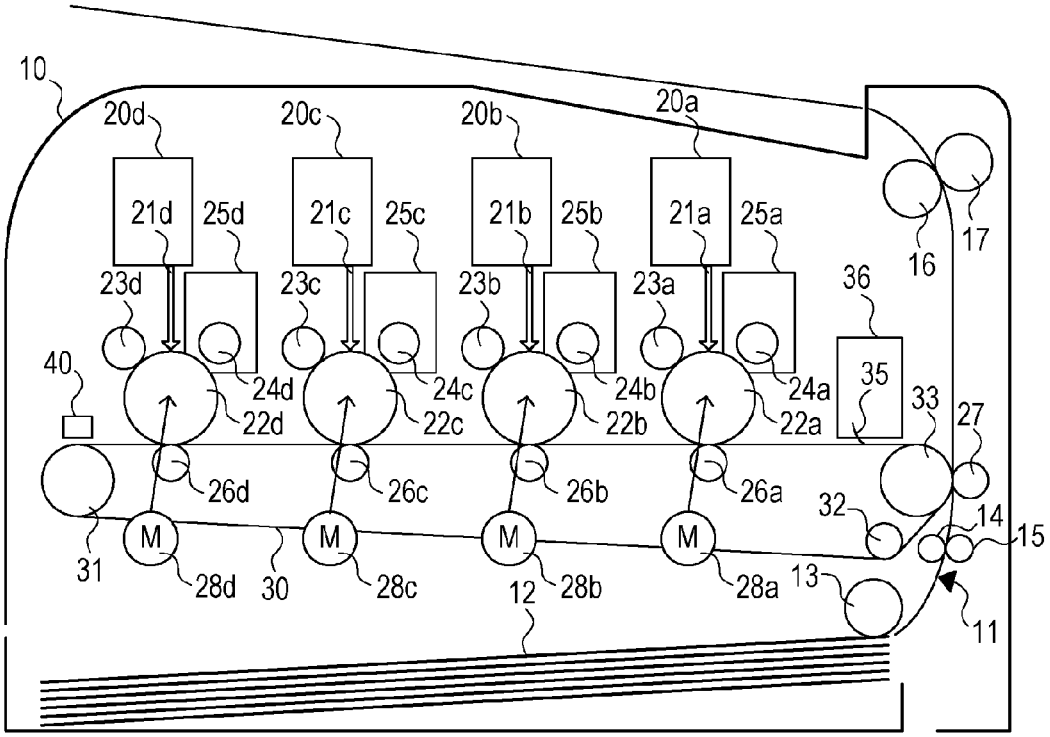
FIG. 12 is a diagram showing the configuration of another in-line (four-drum) color-image forming apparatus.

Next, a second embodiment will be described. FIG. 12 is a diagram illustrating the configuration of an image forming apparatus with a different configuration from that of the first embodiment. The same components as those in the first embodiment are given the same reference numerals, and descriptions thereof will be omitted. The difference between the image forming apparatus illustrated in FIG. 1 and the configuration in FIG. 12 is that the developing sleeves 24*a* to 24*d* are always spaced apart (separated) from the photosensitive drums 22*a* to 22*d*, so that they do not act on the photosensitive drums 22*a* to 22*d*. During printing, the developing high-voltage supply circuits 44*a* to 44*d* apply an alternate bias voltage to the developing sleeves 24*a* to 24*d*, so that toner is reciprocated between the photosensitive drums 22*a* to 22*d* and the developing sleeves 24*a* to 24*d* so that the toner adheres to electrostatic latent images 80. With this configuration, simply stopping the developing high-voltage supply circuits 44*a* to 44*d* prevents the toner from adhering to electrostatic latent images 80 on the photosensitive drums 22*a* to 22*d*.

Furthermore, with the configuration in FIG. 12, the photosensitive drums 22*a* to 22*d* are driven by independent driving sources 28*a* to 28*d*, respectively, so that the rotational speeds can be set individually. Thus, by changing the individual rotational speeds of the photosensitive drums 22*a* to 22*d*, the time after the laser beams 21*a* to 21*d* are emitted until the electrostatic latent images 80 reach the primary transfer rollers 26*a* to 26*d* are kept constant, so that the detected amount of color misregistration in the conveying direction can be canceled. For example, if the rotational speeds of the photosensitive drums 22 are increased, the distances in the subscanning direction between the electrostatic latent images 80 on the photosensitive drums 22 are increased. However, if the rotational speed (moving speed) of the intermediate transfer belt 30 is not changed, the distances in the subscanning direction between toner-image transfer positions are decreased by contrast. Accordingly, extension and contraction in the subscanning direction of images formed on the intermediate transfer belt 30 are substantially insignificant.

On the other hand, this embodiment assumes a configuration in which the phases of the photosensitive drums 22*a* to 22*d* are not detected. However, if the axis of the photosensitive drum 22*a* has a considerable inclination, the measurement of the time at which the electrostatic latent image 80 reaches the primary transfer roller 26*a* also changes. Thus, this embodiment performs a plurality of measurements and corrects color misregistration on the basis of the average thereof. It is needless to say that the processings in the following flowcharts can also be applied to the case in which the image forming apparatus illustrated in FIG. 1 is used.

Figure 13:
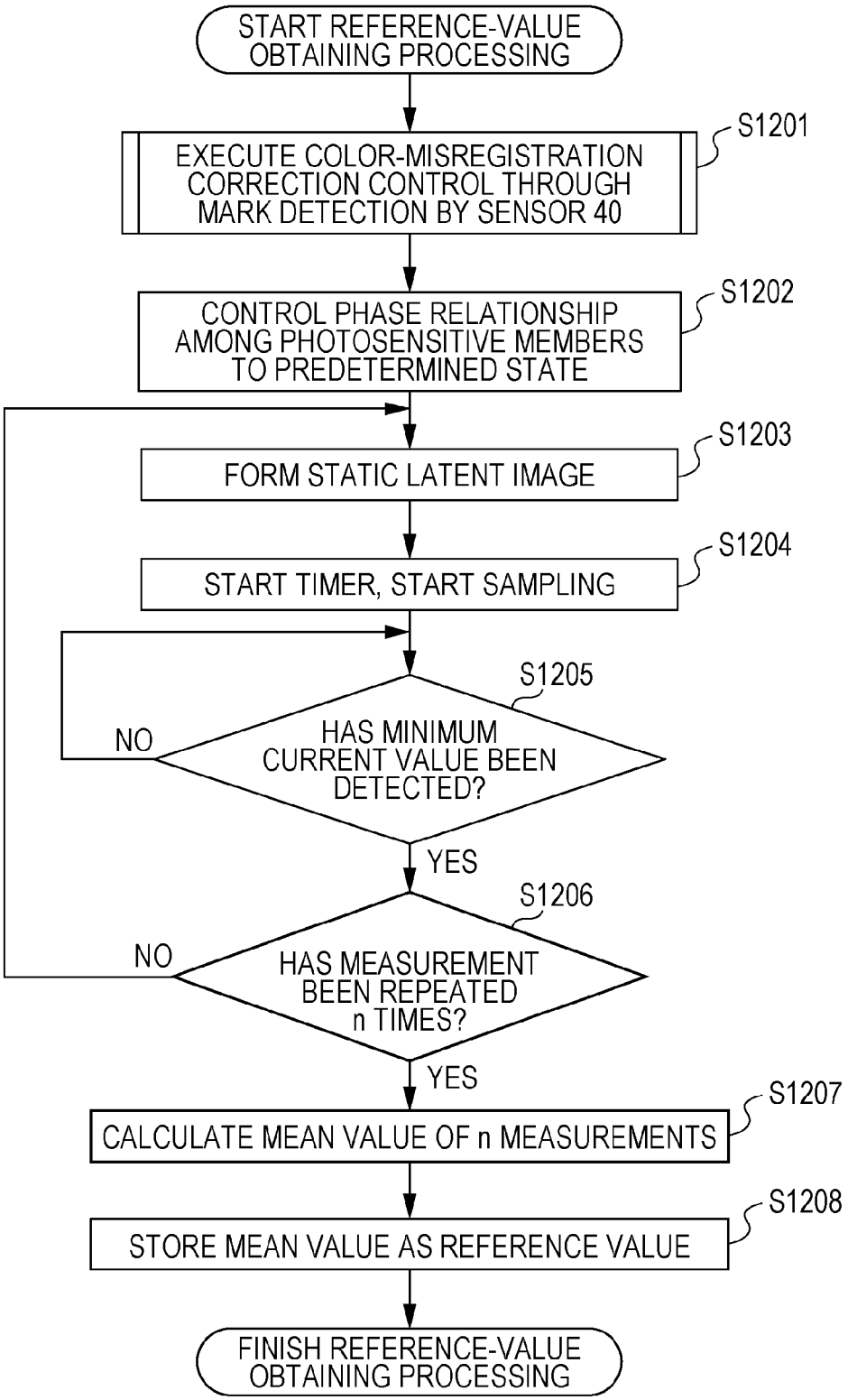
FIG. 13 is a flowchart for another reference-value obtaining processing.

The flowchart in FIG. 13 shows reference-value acquisition processing in the second embodiment. The flowchart in FIG. 13 is performed independently for the individual colors.

First, since processing in steps S1201 to S1205 is the same as that in steps S501 to S505 of FIG. 5, a detailed description thereof will be omitted here.

In step S1206, the control unit 54 performs control to repeat the processing from steps S1203 to S1205 until n times of timer-value measurement for detecting a minimum current is performed to cancel an influence when the axes of the photosensitive drums 22*a* to 22*d* are inclined, where n is an integer greater than or equal to 2. In the case where the color-misregistration correcting electrostatic latent images 80 corresponding to n times corresponds to less than the perimeter of the photosensitive drum 22, for example, half of the perimeter of the photosensitive drum 22, formation of the color-misregistration correcting electrostatic latent images 80 in a given rotation phase in step S1203 is particularly effective.

In step S1206, if the control unit 54 determines that n times of measurement has finished, then, in step S1207, the control unit 54 calculates the mean value of timer values (times) acquired by n times of measurement. In step S1208, the control unit 54 stores the data of the mean value (representative time) as a representative value (reference value) in the EEPROM 324. The stored information indicates a target reference state that is aimed at for color-misregistration correction control. For color-misregistration correction control, the control unit 54 performs control so as to eliminate displacement from the reference state, in other words, to recover the reference state. For calculating the mean, there may be various calculation methods, such as simple average and weighted average. In terms of cancelling a component of the rotation cycle of the photosensitive drum 22, such as the eccentricity of the photosensitive drum 22, the present invention is not limited to the method for calculating the mean value. For example, a simple summing or weighted summing may be adopted provided that it is a calculation for cancelling a component of the rotation cycle of the photosensitive drum 22. The term "cancel" here does not mean complete cancel but is used in the sense of at least reducing the influence of a component of the rotation cycle of the photosensitive drum 22. Of course, complete cancel may be adopted if possible. Since the reference value is calculated in step S1207 on the basis of a plurality of items of acquired data, the accuracy can be improved more than at least by calculating a reference value on the basis of a single item of data.

Flowchart for Color-misregistration Correction Control

Next, a flowchart in FIG. 14 will be described. The same processings as those in FIG. 13 are given the same step numbers. The flowchart in FIG. 14 is executed independently for the individual colors.

Figure 14:
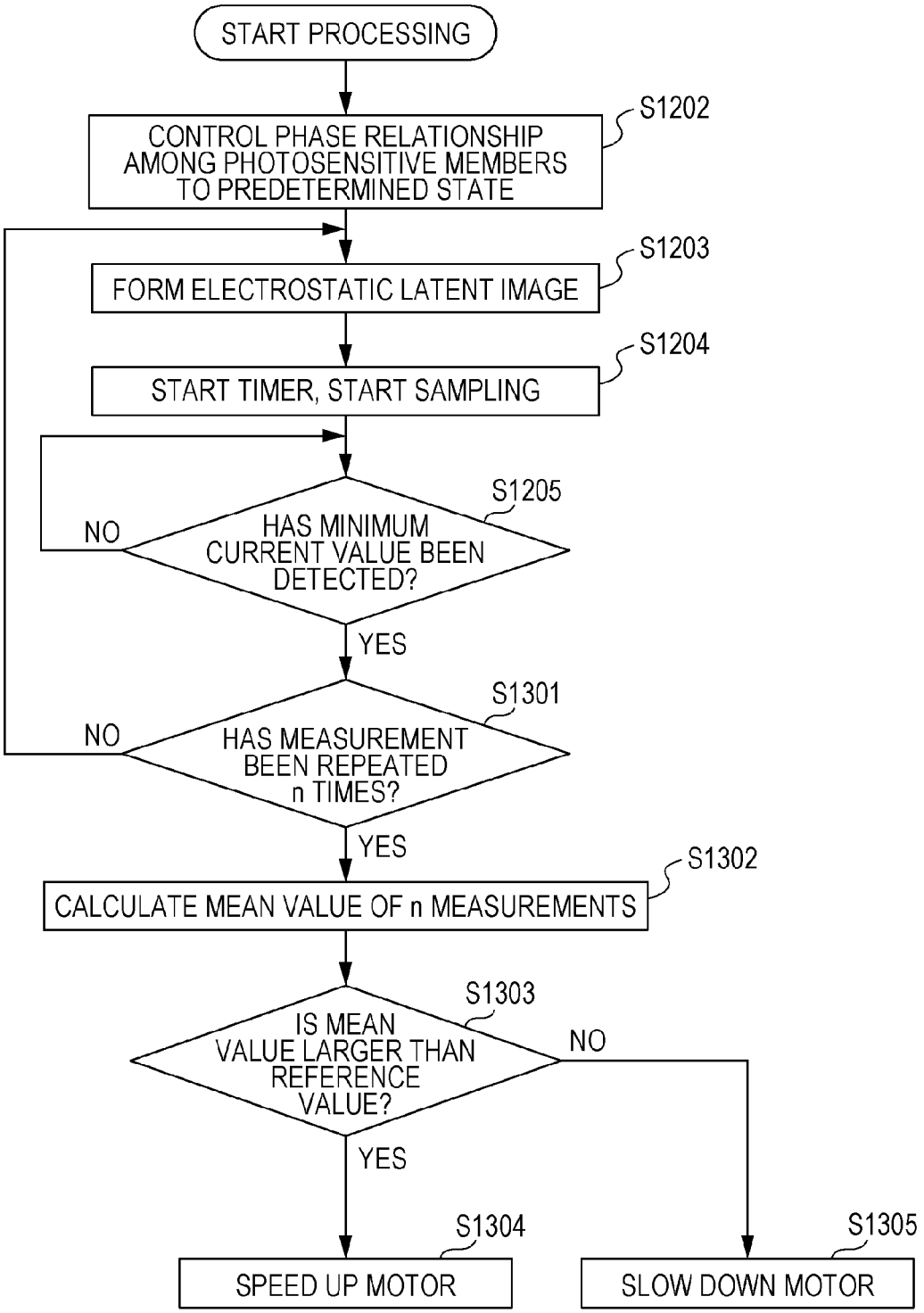
FIG. 14 is a flowchart for another color-misregistration correction control.

First, the processing from steps S1202 to S1205 in FIG. 14 are the same as the corresponding processings in FIG. 13, as described above. The control unit 54 repeatedly executes processing from steps S1203 to S1205 until n times of timer-value measurement for detecting a minimum current is performed to reduce an influence when the rotation axes of the photosensitive drums 22*a* to 22*d* are inclined.

In step S1301, if the control unit 54 determines that n times of measurement has finished, then, in step S1302, the control unit 54 calculates the mean value of the timer values acquired by n times of measurement. In step S1303, the control unit 54 reads the reference value stored in step S1208 of FIG. 13 from the storage unit (EEPROM 324). The control unit 54 compares the calculated mean value and the read representative value (reference value). This is not limited to the mean value in the sense of canceling a component of the cycle of the photosensitive drum 22, the present invention is not limited to the method for calculating the mean value, as described in steps S1207 and S1208.

If the mean value is larger than the reference value, then in step S1304, the control unit 54 speeds up the rotational speed of the photosensitive drum 22, which is an image formation condition, during printing by an amount corresponding to the time. That is, the motor is speeded up. On the other hand, if the mean value is smaller than the reference value, then, in step S1305, the control unit 54 decreases the rotational speed of the photosensitive drum 22, which is an image formation condition, during printing by an amount corresponding to the time. That is, the color misregistration is corrected by slowing down the motor. In this way, by the processing in steps S1304 and S1305, the present color misregistration state can be returned to a reference color misregistration state (reference state). In steps S1304 and S1305 of FIG. 14, the processings in steps S1002 and step S1003 described in the flowchart of FIG. 11 may be performed for correction of an image formation condition.

Dispersion of Phase of Photosensitive Drum

In the case where the processing of electrostatic latent image scanning in step S1203 of FIGS. 13 and 14 is executed in a no-image area between pages, the number of determinations, n, in step S1206 of FIG. 13 and in step S1301 of FIG. 14 depends on the sizes of the components of the image forming apparatus. Specifically, it is determined from the sheet size, the perimeters of the photosensitive drums 22, and the width of a no-image area in the image moving direction (the rotating direction of the photosensitive drums 22).

Figure 15A:
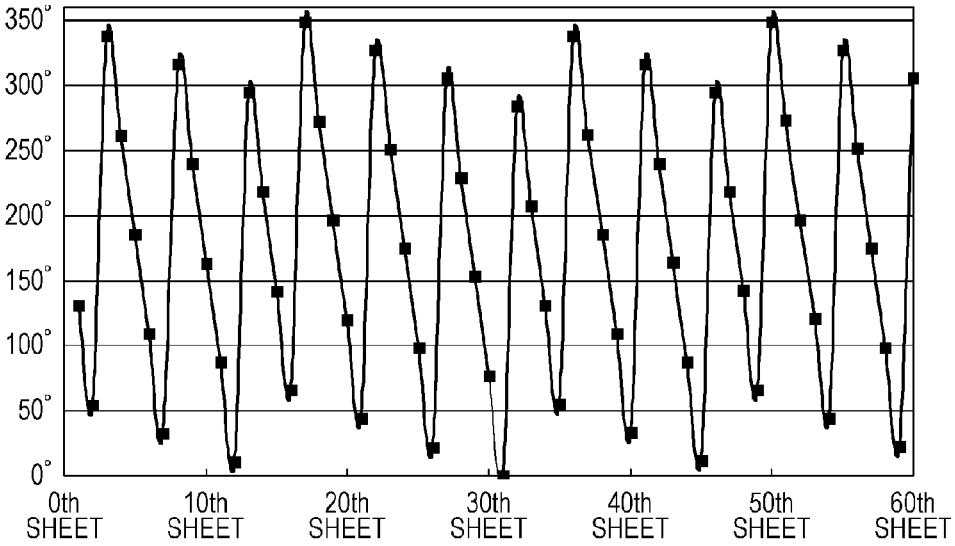
FIGS. 15A and 15B are diagrams showing examples of dispersion of the phases of a photosensitive drum during data sampling.
Figure 15B:
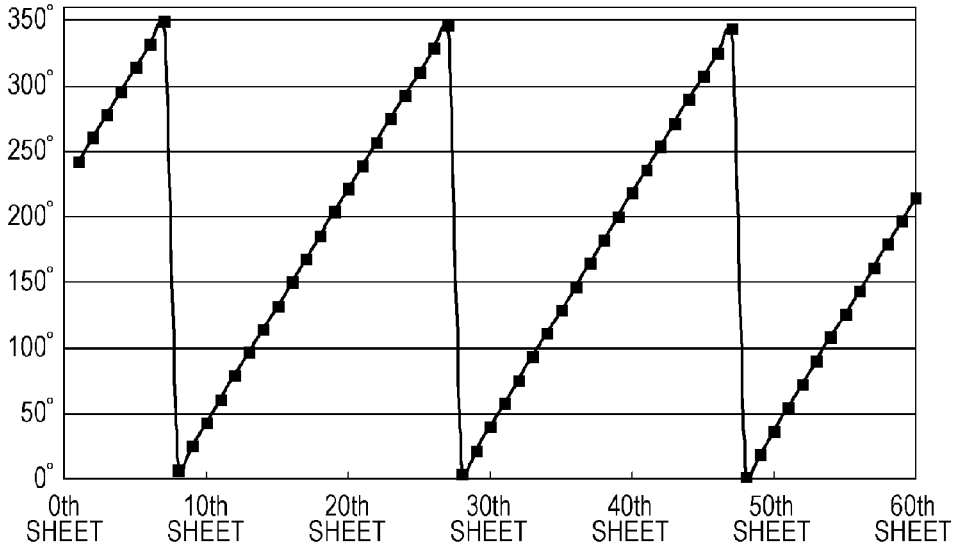

How the phase of the photosensitive drum 22 at the center of individual no-image areas changes in the case where, for example, the sheet size is A4 (297 mm), the width of the no-image area in the moving direction is 4.0 mm, and the perimeter of the photosensitive drum 22 is 75.4 mm is shown in the graph of FIG. 15A. FIG. 15B shows an example of the case of different sheet size, width of the no-image area, and perimeter of the photosensitive drum 22. Descriptions in FIGS. 15A and 15B also apply to the individual colors.

The graphs of FIGS. 15A and 15B show what phases of the photosensitive drum 22 the electrostatic latent images 80 are formed in when step S1203 of FIGS. 13 and 14 is executed at the center of each no-image area. Both FIGS. 15A and 15B show that forming the electrostatic latent images 80 in a plurality of no-image areas in step S1203 of FIGS. 13 and 14 uniformizes or disperses the phase condition of the photosensitive drum 22.

Figure 16:
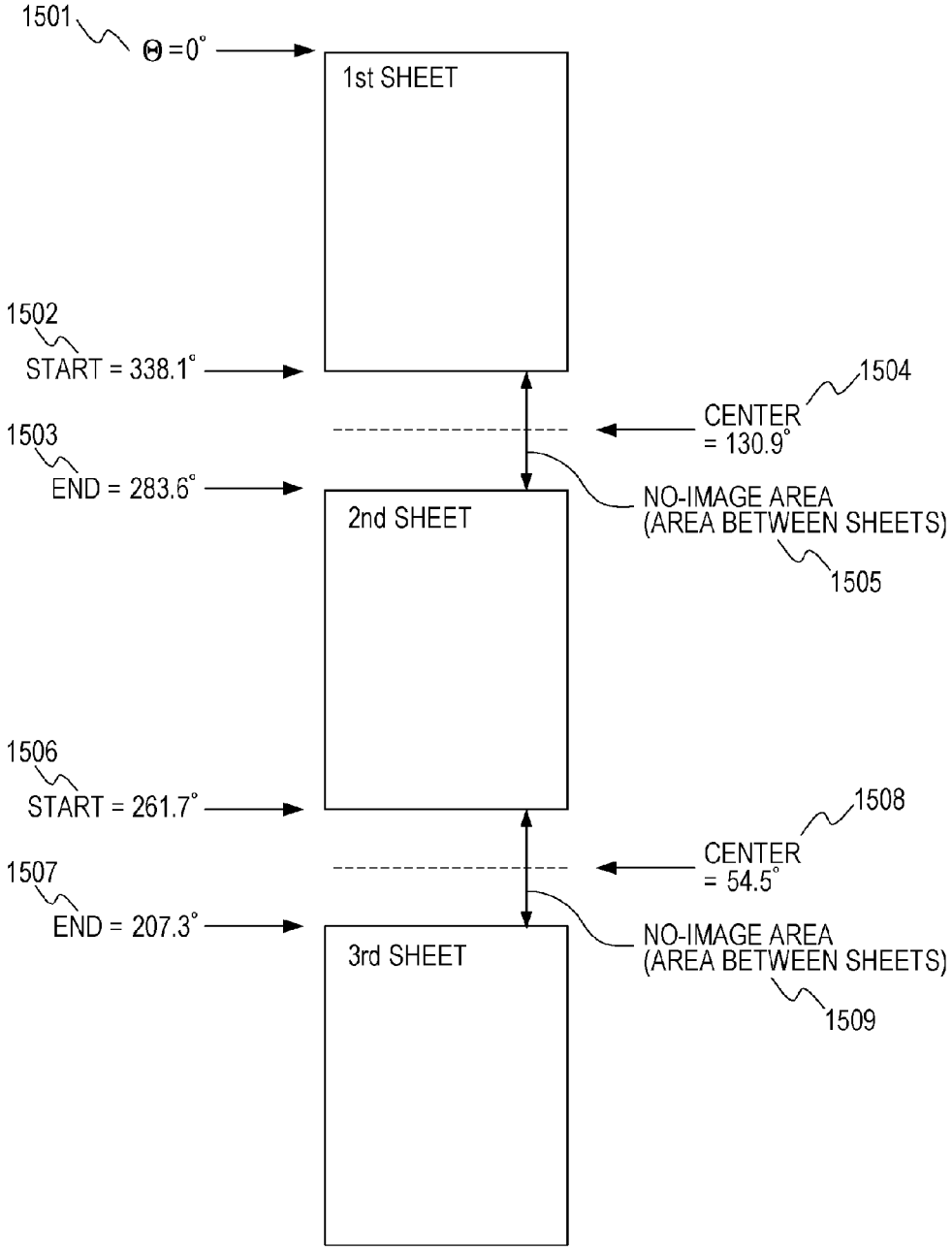
FIG. 16 is a diagram illustrating a sheet size and a no-image area width.

FIG. 16 is a diagram illustrating what the sheet size and the width of the no-image area indicate. FIG. 16 illustrates the correlation between primary transfer positions when toner images are temporarily transferred onto the intermediate transfer belt 30 and the phases of the photosensitive drum 22 when exposure corresponding to the toner image is performed. The no-image area can also be defined as an area on the photosensitive drum 22, such as an area other than an area on which an electrostatic latent image can be formed during image formation (effective image area) and an area between pages (an area between sheets). The no-image area can also be defined as a period (time) during which the scanner unit 20 does not perform laser irradiation for image formation on individual pages.

In FIG. 16, the phases at a start position 1502 (1506), a center 1504 (1508), and an end position 1503 (1507) of a no-image area 1505 (1509) depend on the phase of the photosensitive drum 22 corresponding to a position 1501 and the sheet size. The phases of the photosensitive drum 22 are the phases of the photosensitive drum 22 when toner images are exposed to light assuming that the toner images are primarily transferred, as described above.

In FIG. 16, although the phase at the position 1501 is zero, there is no problem if it is any other value. That is, even if the phase at the position 1501 is not zero, the timing at which no-image area in which the changes in phase shown in FIGS. 15A and 15B appear is simply shifted. That is, there is no great difference in the sense that the phases of the photosensitive drum 22 are dispersed during formation of electrostatic latent images 80 in step S1203 of FIGS. 13 and 14.

As described above, since the flowcharts in FIGS. 13 and 14 are executed by the control unit 54, in addition to the same advantages as in the first embodiment, color-misregistration correction control with higher accuracy than that using a mean value can be achieved. Furthermore, color-misregistration correction control that does not depend on the phases of the photosensitive drums 22 when electrostatic latent images for color misregistration correction are formed can be performed, thus allowing higher flexibility to be provided in terms of the start timing of color-misregistration correction control.

Next, a third embodiment will be described. In the foregoing embodiments, the value of an electric current flowing via the primary transfer roller 26*a*, the photosensitive drum 22*a*, and the ground in accordance with the output voltage of the output terminal 53 is detected as an output value for the surface potential of the photosensitive drum 22*a*. However, the present invention is not limited thereto. In addition to the primary transfer rollers 26*a* to 26*d*, the charging rollers 23*a* to 23*d* and the developing sleeves 24*a* to 24*d* are provided around the photosensitive drums 22*a* to 22*d*. The first or second embodiment can also be applied to the charging rollers 23*a* to 23*d* or the developing sleeve (developing rollers) 24*a* to 24*d*. In other words, an output value for the surface potentials of the photosensitive members 22*a* to 22*d* when the electrostatic latent images 80 formed on the photosensitive members 22*a* to 22*d* have reached the charging rollers 23*a* to 23*d* or the developing sleeves (developing rollers) 24*a* to 24*d* serving as processing units may be detected, as described above.

Figure 17:
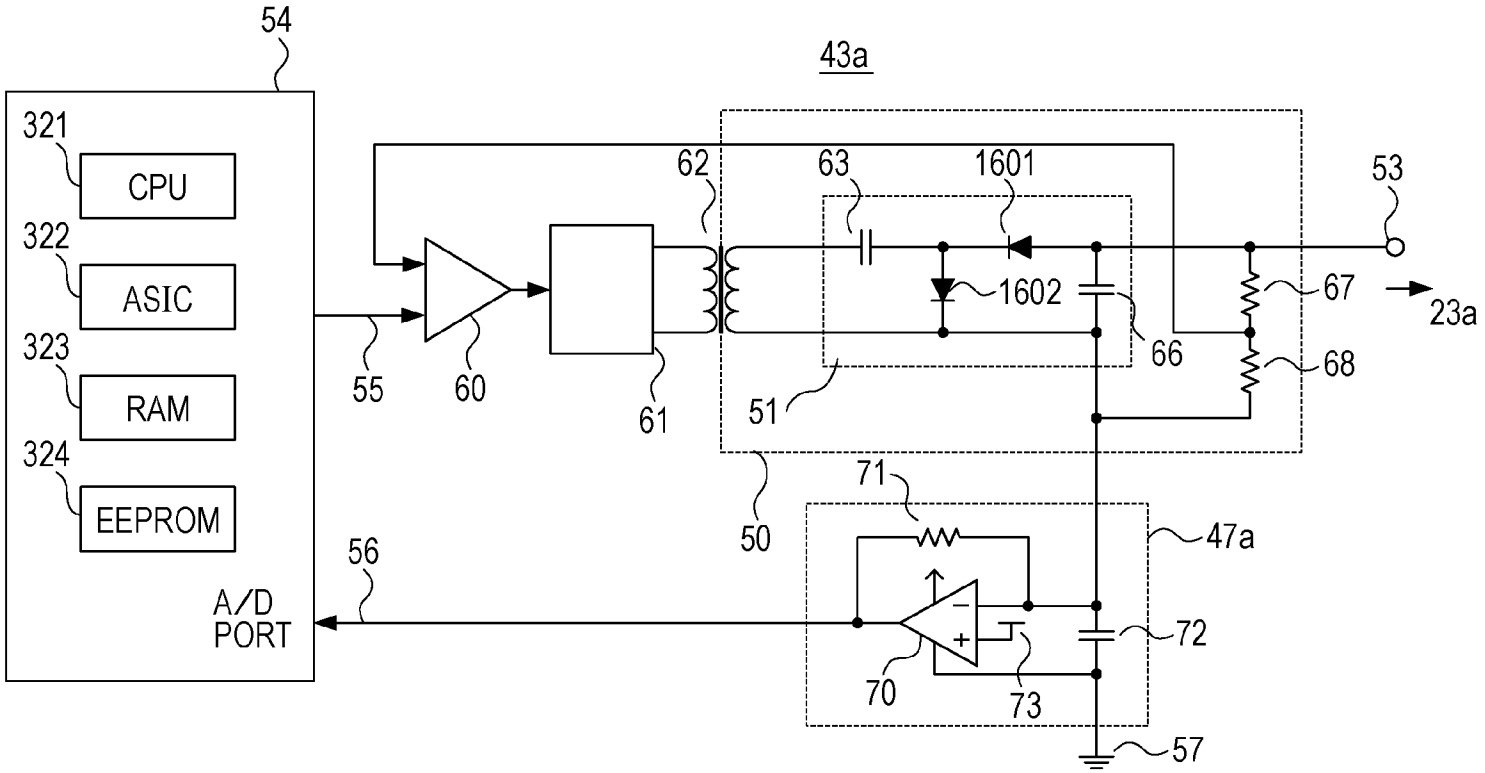
FIG. 17 is a diagram of another high-voltage supply circuit.

A case where the value of an electric current flowing via the charging roller 23 and the photosensitive drum 22 is detected as an output value for the surface potential of the photosensitive drum 22 will be described by way of example. In this case, charging high-voltage supply circuits 43*a* to 43*d* (see FIG. 17) connected to the individual charging rollers 23*a* to 23*d* may be provided, which may be the same as the primary-transfer high-voltage supply circuit 46*a* shown in FIG. 4, and the output terminal 53 may be connected to a corresponding one of the charging rollers 23. The charging high-voltage supply circuits 43*a* to 43*d* in this case is shown in FIG. 17. One of differences from that in FIG. 4 is that the output terminal 53 is connected to the charging roller 23*a*. Another difference is that diodes 1601 and 1602, which are opposite in directions of cathode and anode to the diodes 64 and 65, constitute the high-voltage supply circuit. This is because the primary transfer bias voltage is positive in the image forming apparatus of this embodiment, while the charging bias voltage is negative. Since the charging high-voltage supply circuits 43*b* to 43*d* of the other colors have the same circuit configuration as that shown in FIG. 17, detailed descriptions thereof will be omitted as in the primary-transfer high-voltage supply circuits 46*a* to 46*d*.

The flowcharts in FIGS. 5, 11, 13, and 14 may be executed by the charging high-voltage supply circuits 43*a* to 43*d*, instead of the primary-transfer high-voltage supply circuits 46*a* to 46*d*. In this case, a target current value set in advance for the detection voltage 56 is set as appropriate in consideration of the characteristics of the charging rollers 23, relationship with the other components, etc.

Furthermore, electrical-current detection circuits 50*a* to 50*d* of the charging high-voltage supply circuits 43*a* to 43*d* may be operated so that the primary transfer rollers 26*a* to 26*d* are spaced apart from the intermediate transfer belt 30 when latent marks (electrostatic latent images 80) formed on the individual photosensitive drums 22 pass through the nip between the photosensitive drums 22 and the intermediate transfer belt 30 and/or the gap (the clearance) in the vicinity of the nip. The high voltage output of the primary transfer rollers 26*a* to 26*d* may be turned off (zero) without separation. This is because portions at the dark potential VD (for example, −700 V) on the photosensitive drums 22 are turned positive by positive electric charge supplied from the primary transfer rollers 26*a* to 26*d* more than a portion at the light potential VL (for example, −100 V). In other words, the width of the contrast between the dark potential VD and the light potential VL is reduced due to the positive discharge described above. In contrast, avoiding it allows the width of the contrast between the dark potential VD and the light potential VL to be maintained, thus allowing the range of the change in detecting current to be kept wide.

Figure 18A:
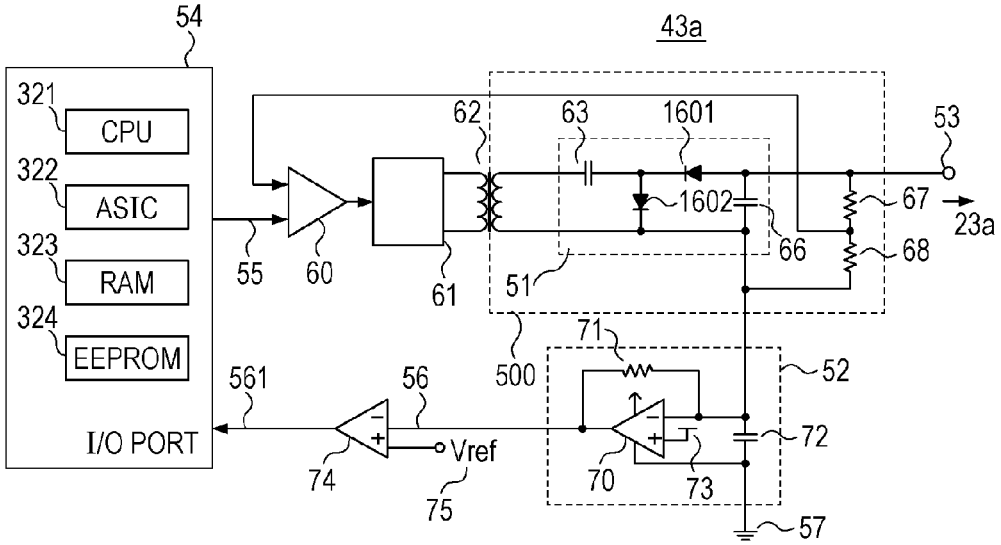
FIG. 18A is a diagram of another high-voltage supply circuit.
Figure 18B:
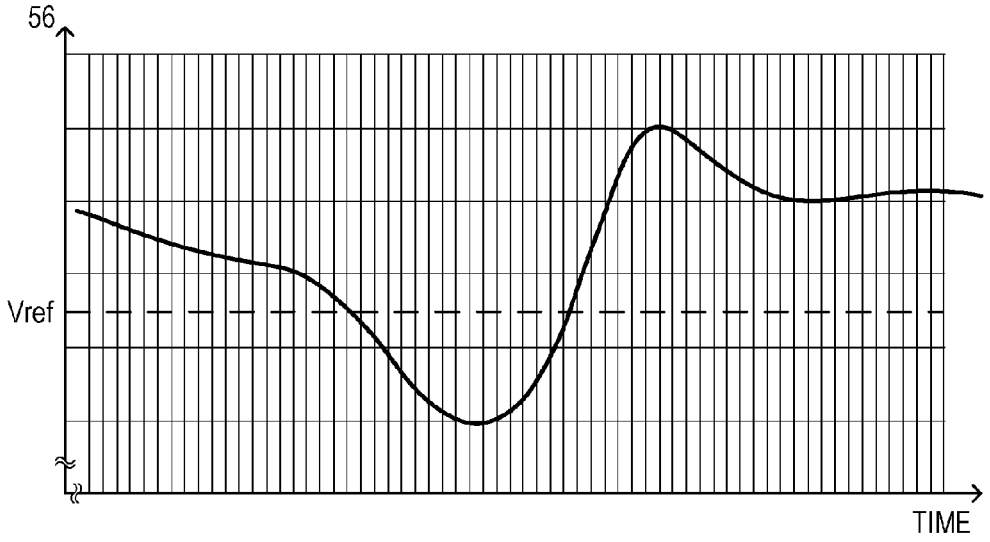
FIG. 18B is a diagram showing an example of the detection result of the high-voltage supply circuit.

FIGS. 18A and 18B show another charging high-voltage supply circuit 43*a*. A difference from that in FIG. 17 is that the detection voltage 56 indicating the amount of detection current is input to a negative input terminal (inverting input terminal) of a comparator 74. A positive input terminal of the comparator 74 receives a threshold value, Vre f75, as an input. If the input voltage of the inverting input terminal falls below the threshold value, the output becomes Hi (positive), and a binarized voltage value 561 (high voltage) is input to the control unit 54. The threshold value Vref75 is set between the minimum value of the detection voltage 561 when the color-misregistration correcting electrostatic latent image 80 passes a position facing the processing unit and the value of the detection voltage 561 before the passage. The rising edge and falling edge of the detection voltage 561 are detected by single detection of the electrostatic latent image 80. The control unit 54 detects, for example, the midpoint of the rising and falling edges of the detection voltage 561. The control unit 54 may detect one of the rising and falling edges of the detection voltage 561.

In the foregoing embodiments, a predetermined condition that the output of the primary-transfer high-voltage supply circuit 46 should satisfy is that the detection voltage 56 takes a minimum value lower than a certain value. However, the predetermined condition needs only indicate that the electrostatic latent image 80 formed on the photosensitive drum 22 has passed a position facing the processing unit. For example, the predetermined condition may be that the detection voltage 561 falls below the threshold value, as described with reference to FIGS. 18A and 18B. This has already been described in the detailed description of step S505 of the first embodiment using FIG. 8. Accordingly, there may be various conditions for detecting the electrostatic latent images 80 in the flowcharts described above and flowcharts described later.

In addition to the charging and the transfer, development is also possible. For the development, the developing high-voltage supply circuits 44*a* to 44*d* (including electrical-current detection circuits) may be operated to execute the flowcharts in FIGS. 5, 11, 13, and 14. A target current value in this case is the same as that of the charging high-voltage supply circuits 43*a* to 43*d* and may be set as appropriate in consideration of the characteristics of the developing sleeves 24 and the relationship with the other components.

When the developing high-voltage supply circuits 44*a* to 44*d* are operated, the potential of the output voltage needs to be set higher than VL so that toner does not adhere to the photosensitive drums 22. For example, if VL is a negative voltage, −100 V, the output of the developing high-voltage supply circuits 44*a* to 44*d* may be set to a voltage of −50 V, which is a negative voltage and whose absolute value is smaller than VL. Alternatively, a circuit similar to the primary-transfer high-voltage supply circuit 46 illustrated in FIG. 4 may be added to each of the developing high-voltage supply circuits 44*a* to 44*d*, and when VL is a negative voltage, −100 V, a voltage (reverse bias) with opposite polarity may be output.

According to the above description, the color-misregistration correcting electrostatic latent images 80 can be detected using the charging rollers 23 or the developing sleeves 24. This can provide the following advantages in addition to the advantages of the first and second embodiments. Specifically, in the case where the primary transfer rollers 26 are used, the belt 30 is interposed between the primary transfer rollers 26 and the photosensitive drums 22, while in the case where the charging rollers 23 or the developing sleeves 24 are used, detection of the surface potentials of the photosensitive drums 22 can be performed under a situation without such interposition.

Next, a fourth embodiment will be described. In the first to third embodiments, the control unit 54 sets a value acquired in accordance with the flowcharts of FIGS. 5 and 13 as a target value (reference state) for the color-misregistration correction control (the processing of the flowcharts in FIGS. 11 and 14); however, what value is to be set as the target value is not limited thereto. For example, the difference between a value obtained in step S506 of the flowchart in FIG. 5 for a reference color (for example, yellow) and a value obtained in step S506 for a measurement color (a color other than yellow) may be set as a reference value.

Specifically, the control unit 54 first executes the flowchart of FIG. 5 or 13 for the individual colors. The control unit 54 stores the difference values between the measured value of a reference color at that time and measured values of individual measurement colors in the EEPROM 324. More specifically, the control unit 54 stores the difference value between Y and M, the difference value between Y and C, and the difference value between Y and Bk as reference values in the EEPROM 324. The control unit 54 again obtains the difference value between Y and M, the difference value between Y and C and the difference value between Y and Bk and determines whether the obtained individual difference values are larger than corresponding one of the difference values stored in the EEPROM 324. This processing corresponds to the processing of step S1001 in FIG. 11 and the processing of step S1303 in FIG. 14, described above. If the control unit 54 determines that a difference abstained again is larger than a difference stored before, the control unit 54 performs the same processing as those in steps S1002 and S1304 for the measurement color. If the control unit 54 determines that the difference obtained again is larger than the difference stored before, the control unit 54 performs the same processing as those in steps S1003 and S1305 for the measurement color. As described above, for the comparison between the reference value and the measured value by the control unit 54, what value is used as the reference value is not limited to the form described in the first to third embodiments. The difference value between the reference value and the measured color may be used as the target (reference state) of the color-misregistration correction control, as described in the fourth embodiment.

Modifications

Although the image forming apparatus including the intermediate transfer belt 30 has been described in the above description, the present invention can also be applied to an image forming apparatus that employs a method of directly transferring toner images developed on the photosensitive drums 22 to a transfer material (recording material).

Although the description has been made using the primary transfer roller 26*a* as the primary transfer unit by way of example, for example, a contact primary transfer unit using a transfer blade may be applied. As another alternative, a primary transfer unit that forms a primary transfer nip by surface pressure as disclosed in PTL 2 may be applied.

Furthermore, in the above description, current information is detected by the electrical-current detection circuits 47 as surface potential information that reflects the surface potentials of the photosensitive drums 22. This is because the control unit 54 performs constant-voltage control during primary transfer in image formation. On the other hand, another known primary transfer method applies a transfer voltage to a primary transfer unit by a constant-current apply method. That is, constant-current control is employed as a primary transfer method for image formation. In this case, a change in voltage is detected as surface potential information that reflects the surface potential of the photosensitive drums 22. Thus, the same processing as that described above may be performed for the time required to detect the characteristic form of the voltage change, as in the case of FIG. 8. This also applies to the charging high-voltage supply circuits 43*a* to 43*d* and the developing high-voltage supply circuits 44*a* to 44*d* described in the third embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-279897, filed Dec. 15, 2010 and No. 2011-262126, filed Nov. 30, 2011, which are hereby incorporated by reference herein in their entirety.

The invention claimed is:

1. A color-image forming apparatus including image forming units for individual colors and a belt, the image forming units each including a photosensitive member that is rotationally driven, a processing unit that is disposed close to the periphery of the photosensitive member and that is configured to act on the photosensitive member, and a light irradiation unit configured to emit light to form an electrostatic latent image on the photosensitive member, wherein toner images are formed on the belt by operating the image forming units, the apparatus comprising:

a forming unit configured to form electrostatic latent images for color misregistration correction on the photosensitive members of the individual colors by controlling the light irradiation units corresponding to the individual colors;

a power supply unit for each of the processing units corresponding to the individual colors;

a detecting unit configured to detect, for each of the colors, the output of the power supply unit when the electrostatic latent image for color misregistration correction formed on each of the photosensitive members of the individual colors passes through a position facing the processing unit; and a controller configured to perform color-misregistration correction control so as to return a color misregistration state to a reference state on the basis of a detection result of the detecting unit, wherein when the color-misregistration correction control is to be performed, the intensity of at least one of the apply voltage of the processing unit and the output of the light irradiation unit is set higher than that during normal image formation.

2. The color-image forming apparatus according to claim 1, wherein the detecting unit detects that an output value for the surface potential of the photosensitive member output from the power supply unit matches a specific condition.

3. The color-image forming apparatus according to claim 1, wherein the detecting unit detects the time at which an electrostatic latent image formed on the photosensitive member reaches the processing unit on the basis of a timing at which the light irradiation unit forms the electrostatic latent image for color misregistration correction, and the controller performs color-misregistration correction control so as to return a color misregistration state to a reference state on the basis of a comparison between the detected time and the reference value.

4. The color-image forming apparatus according to claim 3, further comprising a storage unit configured to store the time detected by the detecting unit as a reference value.

5. The color-image forming apparatus according to claim 4, wherein the controller forms the electrostatic latent image for color misregistration correction on the photosensitive member by causing the light irradiation unit to emit light at the same rotating position as the rotating position of the photosensitive member when the electrostatic latent image for color misregistration correction corresponding to the reference value is formed.

6. The color-image forming apparatus according to claim 1, wherein the image forming unit forms a toner image for detection on the belt, the image forming unit including a toner-image detecting unit configured to detect the detecting toner image formed on the belt; and the controller continuously performs color-misregistration correction control based on the detection result of the toner-image detecting unit and color-misregistration correction control by forming the electrostatic latent image for color misregistration correction on the photosensitive member.

7. The color-image forming apparatus according to claim 5, wherein the controller forms the electrostatic latent images for color misregistration correction on a plurality of locations on the photosensitive member with the light irradiation unit, the storage unit stores a representative time calculated by the controller on the basis of time detected in correspondence with the electrostatic latent images for color misregistration correction;

thereafter, the detecting unit detects the detecting electrostatic latent images formed by the light irradiation unit on the plurality of locations on the photosensitive member; and the controller performs the color-misregistration correction control on the basis of the representative time and the time detected for each of the detecting electrostatic latent images.

8. A color-image forming apparatus including image forming units for individual colors and a belt, the image forming units each including a photosensitive member that is rotationally driven, a charging unit configured to charge the photosensitive member, a light irradiation unit that emits light to form an electrostatic latent image on the photosensitive member, a developing unit configured to place toner on the electrostatic latent image to form a toner image on the photosensitive member, and a transfer unit configured to transfer the toner image that adheres to the photosensitive member onto the belt, the apparatus comprising:

a forming unit configured to form electrostatic latent images for color misregistration correction on the photosensitive members of the individual colors by controlling the light irradiation units corresponding to the individual colors;

a power supply unit for the charging unit, the developing unit, or the transfer unit disposed for each of the photosensitive members of the individual colors;

a detecting unit configured to detect, for each of the individual colors, the output of the power supply unit when the electrostatic latent image for color misregistration correction formed on each of the photosensitive members of the individual colors passes through a position facing the charging unit, the developing unit, or the transfer unit; and a controller configured to perform color-misregistration correction control so as to return a color misregistration state to a reference state on the basis of a detection result of the detecting unit, wherein when the color-misregistration correction control is to be performed, the absolute value of a voltage applied to the charging unit or the light intensity of the light irradiation unit is set higher than that during normal image formation.

9. The color-image forming apparatus according to claim 8, wherein the detecting unit detects that an output value for the surface potential of the photosensitive member output from the power supply unit of the charging unit, the developing unit, or the transfer unit matches a specific condition.

* * * * *